US008115695B2

(12) United States Patent
Cheng et al.

(10) Patent No.: US 8,115,695 B2
(45) Date of Patent: Feb. 14, 2012

(54) PRINT DIPOLE ANTENNA AND MANUFACTURING METHOD THEREOF

(75) Inventors: Li-Yuan Cheng, Hsinchu (TW); Fu-Chiarng Chen, Hsinchu (TW)

(73) Assignee: National Chiao Tung University, Hsinchu (TW)

( * ) Notice: Subject to any disclaimer, the term of this patent is extended or adjusted under 35 U.S.C. 154(b) by 378 days.

(21) Appl. No.: 12/470,064

(22) Filed: May 21, 2009

(65) Prior Publication Data

US 2010/0283701 A1 Nov. 11, 2010

(30) Foreign Application Priority Data

May 5, 2009 (TW) ..... 98114909 A

(51) Int. Cl.
*H01Q 9/28* (2006.01)

(52) U.S. Cl. ..... 343/795

(58) Field of Classification Search ..... 343/795, 343/702, 700 MS, 797–798, 725, 727
See application file for complete search history.

(56) References Cited

U.S. PATENT DOCUMENTS 5,172,084 A * 12/1992 Fiedziuszko et al. ..... 333/204
6,121,861 A * 9/2000 Yabuki et al. ..... 333/204
7,310,030 B2 * 12/2007 Tsai et al. ..... 333/204
7,694,476 B2 * 4/2010 Cook et al. ..... 52/296

OTHER PUBLICATIONS

Chen, Fu Chiarng, et al., "Design of Novel Multi-Band Printed Dipole Antennas and Miniaturized Printed Folded Dipole Antennas", Department of Communication Engineering, National Chiao Tung University, Hsinchu, Taiwan, R.O.C., Aug. 2008.

* cited by examiner

*Primary Examiner* — Huedung Mancuso
(74) *Attorney, Agent, or Firm* — WPAT, P.C.; Anthony King

(57) ABSTRACT

The present invention discloses a print dipole antenna and manufacturing method thereof. The print dipole antenna has a plurality of resonance frequencies, which comprises a substrate, a ring microstrip line and a ground plane. The ring microstrip line is disposed on one side of the substrate, and the interior of the ring microstrip line is symmetrically disposed with a plurality of parasitic metals. The ground plane is disposed on the other side of the substrate, and has a hollow portion corresponding to the central area of the ring microstrip line. The ring microstrip line has a plurality of end ports including input end ports and output end ports, which may further comprise an open circuit end. The plurality of parasitic metals may be of linear shape or bended in arbitrarily windings. A normal mode signal is fed from the end points of the plurality of parasitic metals.

18 Claims, 24 Drawing Sheets

E-Plane

H-Plane

E-Plane

H-Plane

E-Plane

H-Plane

E-Plane

H-Plane

E-Plane

H-Plane

E-Plane

H-Plane

E-Plane

H-Plane

E-Plane

H-Plane

E-Plane

H-Plane

E-Plane

H-Plane

E-Plane

H-Plane

E-Plane

H-Plane

PRINT DIPOLE ANTENNA AND MANUFACTURING METHOD THEREOF

BACKGROUND OF THE INVENTION

1. Field of the Invention

The present invention relates to a print dipole antenna and manufacturing method thereof; in particular, the present invention relates to a print dipole antenna providing advantages of multiple resonance frequencies, wide frequency band as well as manufacturing method thereof.

2. Description of Related Art

The print dipole antenna provides quite a few advantages in terms of such as slim size, low cost, simple structure, convenient fabrication processes and suitability for integration with solid state devices or microwave integrated circuit modules, thus the print dipole antenna has widely applied in various wireless communication and radar systems. Since the conventional dipole antenna is the narrow frequency band antenna capable of single resonance frequency, many efforts and researches have been devoted to the extension of frequency bandwidth of the print dipole antenna and the increase of its resonance frequency; for example, a print dipole antenna using a double-sided substrate structure in combination with BALanced to UNbalanced (Balun) transformer, or by means of tapered slot feed, or else some proposed a dipole antenna through double-sided integration and the like, and all these approaches may effectively increase the frequency bandwidth; additionally, by adding parasitic metal components or extending dipole antenna arms, it is allowed to excite different resonance modes, so as to achieve the effect of multiple frequency band resonance.

The excitement current plays a significant role in the radiation effect of the dipole antenna. When the current distribution is changed, the radiation field and the polarity orientation may accordingly vary, so the phase and the amplitude of the current signal may almost dominantly determine the radiation effect of the dipole antenna. In a general dipole antenna, based on the design idea, it is undesirable to generate unbalanced current, because the feedings of current having differences in phase or amplitude at two dipole arms may possibly interfere with the expected antenna radiation effect and polarity orientation, while most of the existing documents or research reports are addressed to the issues of unbalanced current phenomenon, rather than providing the dipole antenna specifically designed for unbalanced current.

The conventional print dipole antenna is characterized in single resonance frequency, but limited frequency bandwidth can no longer satisfy the demands in practical applications; whereas improvements proposed at present are mostly designed in terms of structural modifications, which usually require extra extension in structure thereof to increase frequency bandwidth and resonance frequency, thus leading to enlargement in integral antenna area or volume. This consequence is undesirable for the goal of slimness and compact in size, and therefore becomes a challenging issue for the conventional technologies to overcome. Furthermore, balance signal is needed to be fed at the center of the conventional print dipole antenna, thus limiting the feed structure and degrees of freedom, and also the Balun transformer may occupy extra space on the print circuit board and cause unexpected interference to the print dipole antenna.

SUMMARY OF THE INVENTION

With regards to the aforementioned drawbacks in prior art, one of the objectives of the present invention is to provide a print dipole antenna to address the issues of single resonance frequency and narrow frequency bandwidth in the conventional print dipole antenna, and to reduce the integral antenna size after integration of BALanced to UNbalanced (Balun) transformer therewith in prior art. The print dipole antenna according to the present invention may have a plurality of resonance frequencies, which comprises a substrate; a ring microstrip line, disposed on one side of the substrate; a plurality of parasitic metals, symmetrically disposed in the interior of the ring microstrip line; and a ground plane, disposed on the other side of the substrate, and having a hollow portion corresponding to the central area of the ring microstrip line. Herein the shape of the ring microstrip line may be circular, oval, polygonal or any symmetrical shape. The ring microstrip line has a plurality of end ports including input end ports and output end ports, which may further comprise an open circuit end. The plurality of parasitic metals may be of linear shape or bended in arbitrarily windings, which are connected to the output end ports oriented toward the interior of the ring microstrip line. A normal mode signal is fed from the end points of the plurality of parasitic metals.

According to a further objective of the present invention, herein a manufacturing method of the print dipole antenna according to the present invention is disclosed, comprising the following steps: providing a substrate; disposing a ring microstrip line on one side of the substrate; symmetrically disposing a plurality of parasitic metals in the interior of the ring microstrip line; and disposing a ground plane having a hollow portion on the other side of the substrate, wherein the hollow portion corresponds to the central area of the ring microstrip line.

The present invention yet further discloses a print dipole antenna which comprises a ring multiplexer/demultiplexer and two parasitic metals. Herein the ring multiplexer/demultiplexer comprises a substrate, a ring microstrip line and a ground plane. The ring microstrip line further includes an input end port, two output end ports and an open circuit end, and the two parasitic metals are two dipole arms in the conventional dipole antenna, which are connected to the two output end ports. Besides, the layout of the ring multiplexer/demultiplexer is configured by setting open circuit at the summation end port of the conventional 4-port microstrip line ring multiplexer/demultiplexer, removing the ring area of the ground plane corresponding to the central area of the ring microstrip line, feeding at the subtraction end port the normal mode signal and extending the two end ports toward the center of the structure as the output end ports. The signals at the two output end ports may vary according the changes in operation frequency, thus leading to different phase shift and different amplitude ratio, further providing the dipole antenna with balanced and unbalanced feed signals, allowing to generate four resonance frequencies within two times of central frequency of the ring multiplexer/demultiplexer.

Herein the two parasitic metals are placed symmetrically inward slantwise, and by using the current signal whose phase varies in accordance with the frequency, resulting different current distribution modes and effectively equivalent radiation paths synthesized at different operation frequencies, it is thus possible to further excite different resonance modes. Through the selection of central frequency of the ring multiplexer/demultiplexer, the dipole antenna is allowed to provide four resonance frequencies within the frequency band slighter lower than the central frequency and slightly higher than two times of the central frequency, and the positions of such four resonance frequency points can be controlled by means of the total length of the two parasitic metals (which can be modified by adjusting the size of the removed ground plane corresponding to the center of the ring multiplexer/demultiplexer as well as the lengths of extensions and windings within these two parasitic metals), and the positions/lengths of such windings, in which the third and fourth resonance frequencies are less sensitive to variations in lengths of the parasitic metals than the first and the second resonance frequencies. The fourth resonance frequency does not significantly fluctuate along with the variation in profile of the two parasitic metals, but rather, resides to approximate twice of the central frequency of the ring multiplexer/demultiplexer.

Besides, the first resonance mode is created around the central frequency of the ring multiplexer/demultiplexer, which is excited by a pair of balanced signals on the two parasitic metals; while the fourth resonance mode is created nearby twice of the central frequency of the ring multiplexer/demultiplexer, which is excited by a pair of signals having the identical phase and amplitude on the two parasitic metals. When the operation frequency falls within the range of the above-said two resonance frequencies, greater difference may occur in the amplitudes of the signals on the two parasitic metals, and such unbalanced signals of different phases and amplitudes will generate another two resonance modes. Additionally, suppose the first resonance frequency is designed to be higher than the central frequency, then the first three resonance frequencies will mutually connect in series to form a relatively wide operation frequency band. Contrarily, in case that the first resonance frequency is designed to be lower than the central frequency, then no wide frequency band should occur, and the second and the third resonance modes will become feeble. If the first resonance frequency is designed to be just located at the central frequency, then the wide frequency band should still occur, with only the first two resonance frequencies connected in series to form the wide frequency band.

In addition, the present invention further discloses a print dipole antenna which allows the main resonance frequencies to fall in the frequency bands of two communication systems in order to provide a print dipole antenna having two frequency bands. By appropriately modifying the lengths of the two parasitic metals, it is possible to adjust the lower frequency resonance frequency point without alternation to the higher frequency resonance frequency.

The present invention yet further discloses a print dipole antenna which allows the three main resonance frequencies thereof to fall in the frequency bands of three communication systems in order to provide a print dipole antenna having three frequency bands. Since the frequency band plan is essentially based on the first, the second and the fourth resonance frequencies, the frequency band formed by the third resonance frequency must be suitably suppressed. Because the lower frequency resonance frequency is located just at the central frequency of the ring multiplexer/demultiplexer, there is no need to particularly increase or decrease the lengths of the two parasitic metals; but rather, by simply etching off the ring area of suitable size through the center of the ground plane and changing the position and length of vertical windings in the parasitic metals, along with adjustment to the position of the open circuit at the summation end port, it is then possible to vary the impedance matching of the antenna and fulfill the requirements of the present invention.

Also, the present invention still further discloses a print dipole antenna which enables more effective use of all resonance frequencies located within two times of the central frequency of the ring multiplexer/demultiplexer, facilitating full exploitation to the maximum effect of the antenna.

In summary, the print dipole antenna and manufacturing method thereof according to the present invention provides one or more the following benefits:

(1) Feeding at the end point of the parasitic metals (i.e. dipole arms) is a brand new dipole antenna architecture.

(2) It may be implemented by using a double-sided print circuit board (FR4) and simple print technologies, thus enabling lower fabrication cost, but high application value.

(3) The Balun is integrated into the antenna, providing advantages of simpler structure and smaller integral size of the antenna than the conventional print dipole antenna.

(4) Additional resonance frequencies may be excited by effectively using the ring multiplexer/demultiplexer to feed unbalanced signals outside the central frequency, so as to extend applicable frequency bands of the antenna.

(5) There may exist four resonance frequencies within two times of the central frequency of the ring multiplexer/demultiplexer, and it is possible to adjust the size thereof based on the required frequency bands in order to change the central frequency and the positions of the four resonance frequencies, thereby providing high degree of freedom in application. It is also possible to modify the required frequency bands and positions of resonance frequencies according to the needs of the user without affecting the performance of the antenna itself, and operation frequency bands of relatively wide frequency bandwidth can be acquired within two times of the central frequency so long as selecting suitable central frequency of the ring multiplexer/demultiplexer.

(6) It uses the summation end port open circuit to enhance the total output power of the ring multiplexer/demultiplexer, allowing to effectively solve the problem of insufficient output power distribution when operating at two times of the central frequency, and the relationship between of the two output signals in phase and amplitude is not affected, thereby further maintaining good radiation feature. In this way, the operation frequency bands of the ring multiplexer/demultiplexer may be well extended, and higher frequency may be also utilized as the feed network for the antenna.

(7) Since the time-variable current signal on the same set of dipole arms is responsible for radiation processes at different frequencies, simple radiation field profile may be obtained at each resonance frequency, thereby completely excluding the uncertainty and influence probably brought by adding extra structures to increase the resonance frequencies.

DETAILED DESCRIPTION OF THE PREFERRED EMBODIMENTS

Figure 1:
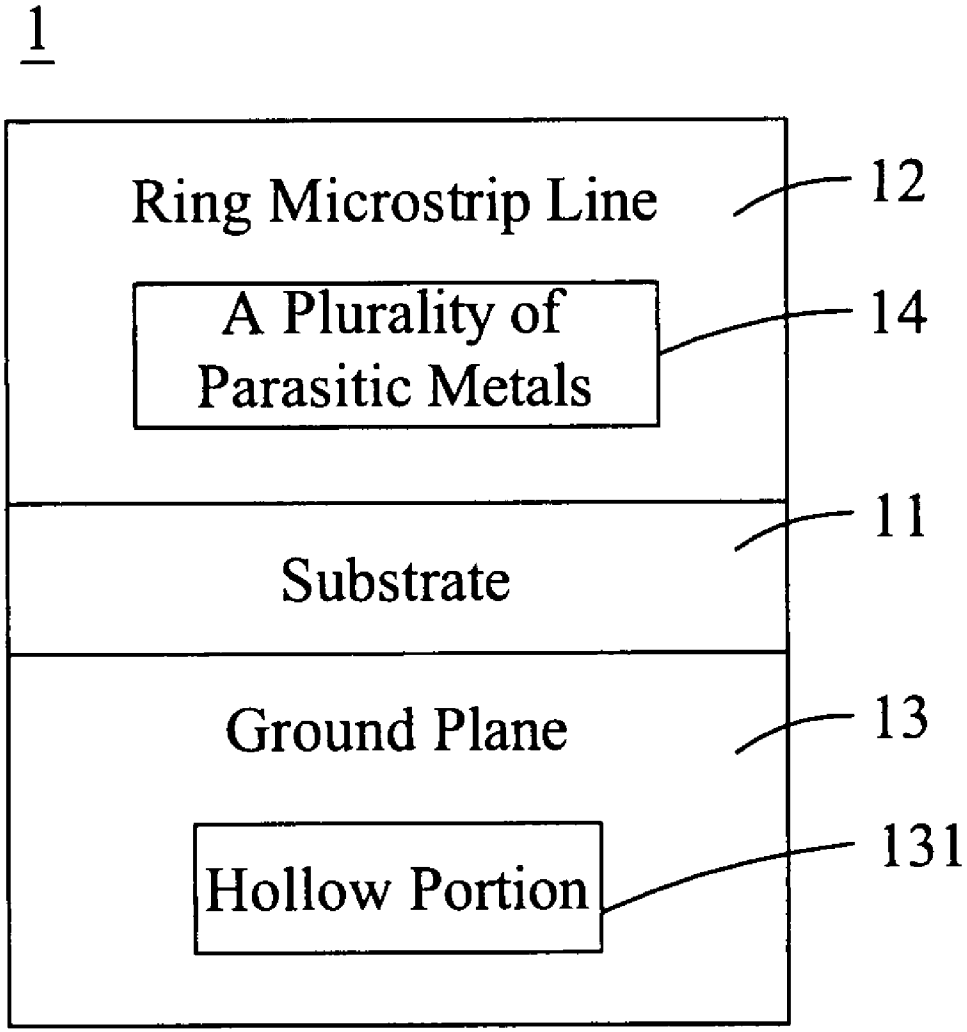
FIG. 1 shows a block diagram of a print dipole antenna according to the present invention.

Refer now to FIG. 1, wherein a block diagram of a print dipole antenna according to the present invention is shown. In the Figure, the print dipole antenna 1 comprises a substrate 11, a ring microstrip line 12 and a ground plane 13. Herein the ring microstrip line 12 is disposed on one side of the substrate 11, and the interior of the ring microstrip line 12 is symmetrically disposed with a plurality of parasitic metals 14. The ground plane 13 is disposed on the other side of the substrate 11, and has a hollow portion 131 corresponding to the central area of the ring microstrip line 12.

Figure 2:
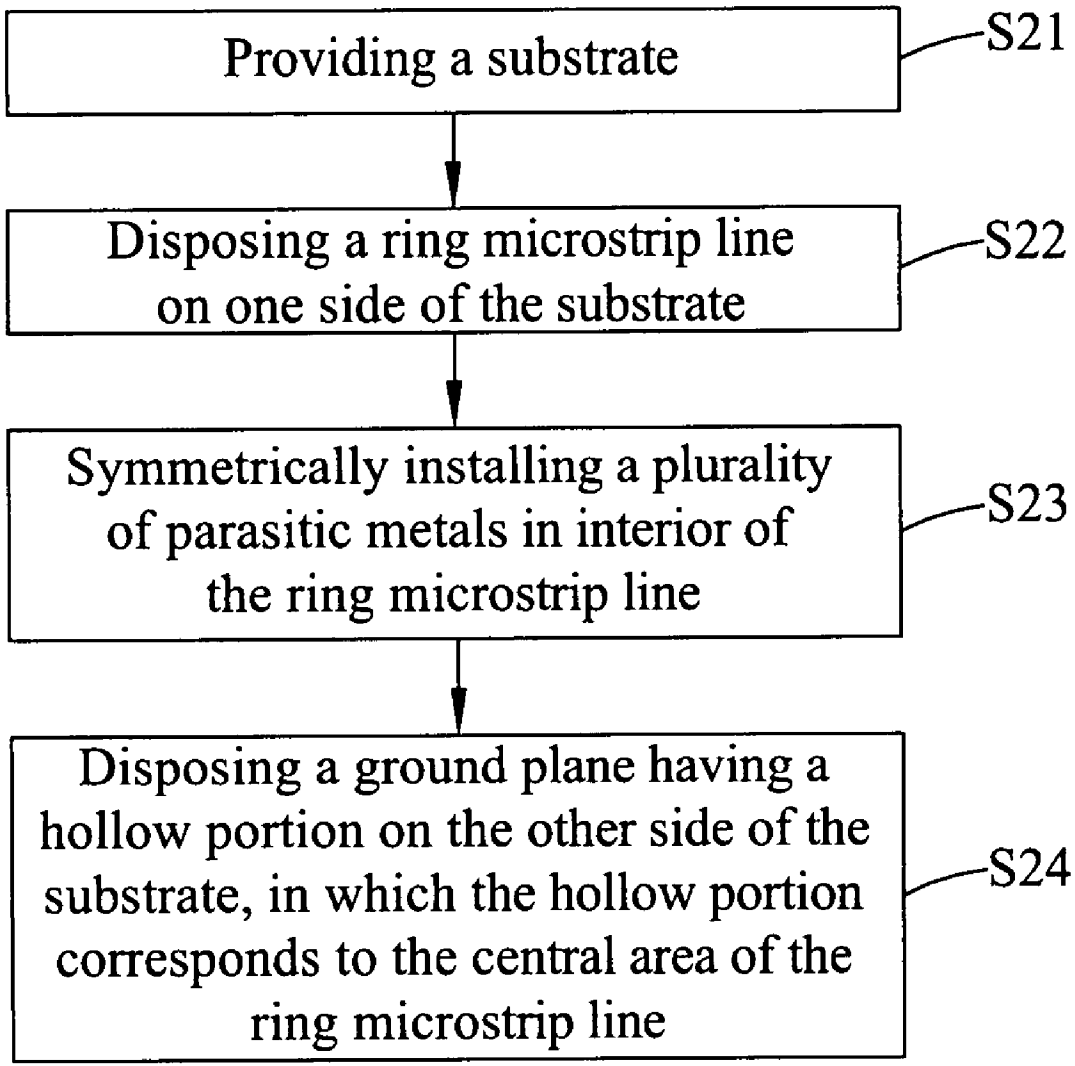
FIG. 2 shows a flowchart for the manufacturing method of the print dipole antenna according to the present invention.

Refer next to FIG. 2, wherein a flowchart for the manufacturing method of the print dipole antenna according to the present invention is shown. The steps of the present method comprise: in step S21, providing a substrate; in step S22, disposing a ring microstrip line on one side of the substrate; in step S23, symmetrically disposing a plurality of parasitic metals in the interior of the ring microstrip line; and in step S24, disposing a hollow portion of a ground plane on the other side of the substrate, which hollow portion corresponding to the central area of the ring microstrip line.

Figure 3A:
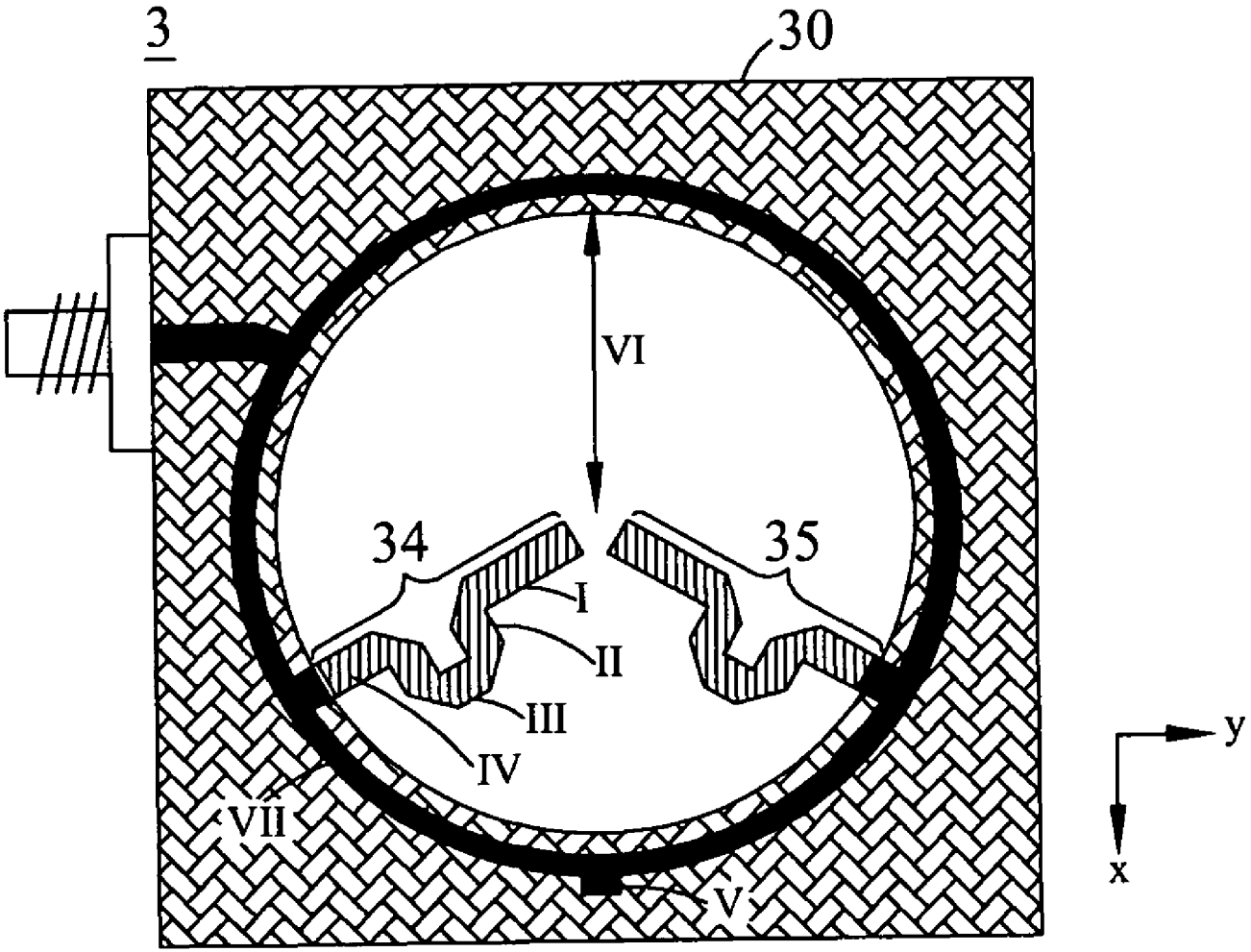
FIG. 3 shows a drawing for a first embodiment of the print dipole antenna according to the present invention.
Figure 3B:
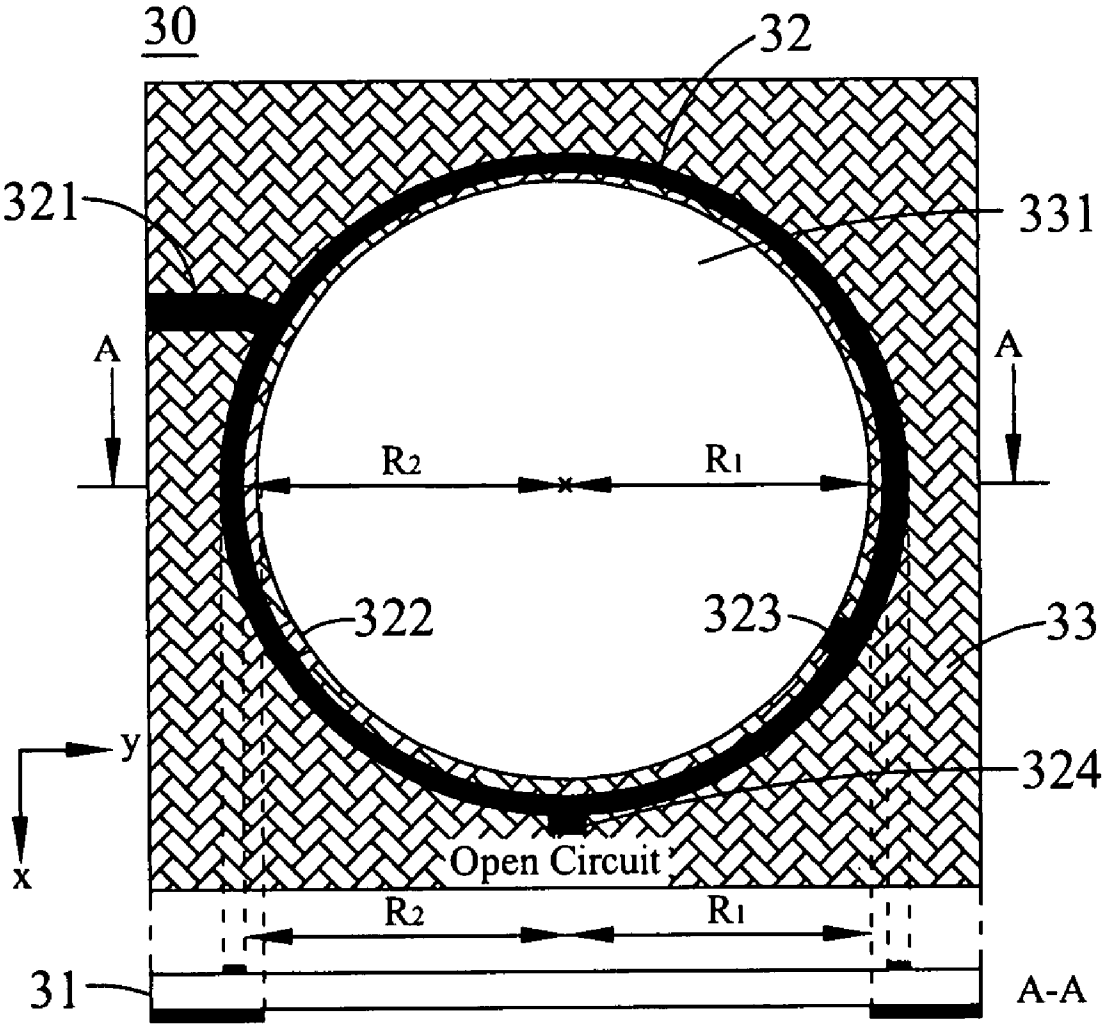

Refer subsequently to FIG. 3, wherein a drawing for a first embodiment of the print dipole antenna according to the present invention is shown. In the Figure, the print dipole antenna 3 comprises two parts, in which the first part is the ring multiplexer/demultiplexer 30 used as a feed network, while the second part are two parasitic metals 34 and 35 used as radiation components. Herein, as shown in FIG. 3B, the ring multiplexer/demultiplexer 30 consists of a substrate 31, a ring microstrip line 32 and a ground plane 33. The ring microstrip line 32 further includes an input end port 321, two output end port 322 and 323 as well as an open circuit end 324. The two parasitic metals 34 and 35 is respectively connected to the two output end ports 322 and 323, and the two parasitic metals 34 and 35 represent the two dipole arms found in the conventional dipole antenna. Additionally, the structure of the ring multiplexer/demultiplexer 30 comprises a plate antenna built by using a double-sided print FR4 circuit board of 0.8 mm in thickness with permittivity 4.4, which comprises two parts: R2 is determined by the central frequency (i.e. the size of microstrip line designed in accordance with such a frequency), and R1 may be arbitrarily modified in order to adjust the lengths of the parasitic metals 34 and 35. The present embodiment uses the subtraction end port of the conventional 4-port microstrip line multiplexer/demultiplexer as the antenna input end port 321 which is the 50 Ohms microstrip line feed of normal mode, and uses the summation end port of the conventional 4-port microstrip line multiplexer/demultiplexer as the open circuit end 324, and also modifies the positions of the original two output end ports 322 and 323 such that the signal previously ought to be transferred outward is now outputted in the direction toward the center of circle; meanwhile, it also changes the shape of the ground plane 33, in which a circular area 331 is removed at the center of the ground plane 33, whose circumference is immediately adjacent to the ends of the two output end ports 322 and 323; in this way, the parasitic metals 34 and 35 may be integrated inside the ring microstrip line 32, and the positions thereof fall in the corresponding circular area 331 of the ground plane 33. The design of the open circuit end 324 allows to, when operating within two times of the central frequency, totally reflect the power transferred to the summation end port and greatly reduces power reflection from the input end port 321, thereby effectively improving the output power.

Additionally, in FIG. 3A, two parasitic metals 34 and 35 indicate symmetrical structures with an open circuit as the end thereof, in which the time-variable current signals in the ring multiplexer/demultiplexer 30 enter into the two parasitic metals 34 and 35 and become mutually independent, with whose features being almost completely determined by the ring multiplexer/demultiplexer 30, thus while operating at different frequencies, the ring multiplexer/demultiplexer 30 is able to provide balanced and unbalanced signals at the two parasitic metals 34 and 35. Besides, since the signals fed in the two parasitic metals 34 and 35 at different frequencies has different phases and amplitudes, it is designed to slantwise dispose the two parasitic metals 34 and 35 respectively at a 30-degree angle against the horizontal plane along the direction of the two output end ports 322 and 323 of the ring multiplexer/demultiplexer 30, such that the current therein, at different frequencies, may be synthesized into different current vectors and have effective radiation lengths in order to achieve different resonance modes. For the lengths and winding design of the two parasitic metals 34 and 35, the sizes of I~VI are mainly used to adjust the impedance matching and resonance frequency position, VII is determined by the width of the dielectric 50 Ohms microstrip line. Here, within 0.85~1.1 times of the central frequency of the ring multiplexer/demultiplexer 30, it is possible to get a pair of differential balance signals having identical amplitude and 180-degree phase shift at the two output end ports 322 and 323; within two times of the central frequency of the ring multiplexer/demultiplexer 30, it is possible to get a pair of output signals having identical amplitude and size at the two output end ports 322 and 323; whereas while operating at other frequencies within two times of the central frequency, the two output end ports 322 and 323 provide a set of unbalanced output signals, with relationship in phase thereof may vary based on the frequency. Also, as operating at the central frequency, the input power may be all evenly distributed to the two output end ports 322 and 323; while operating at two times of the central frequency, ⅚ input power can be evenly distributed to the two output end ports 322 and 323, and the rest ⅙ input power is reflected at the input end port 321. When the first resonance frequency of the antenna is designated at the central frequency of the ring multiplexer/demultiplexer 30, the fourth resonance frequency will be located at two times of the central frequency, while the second and the third resonance frequencies respectively occurs at approximately 1.3 and 1.6 times of the central frequency.

Figure 4:
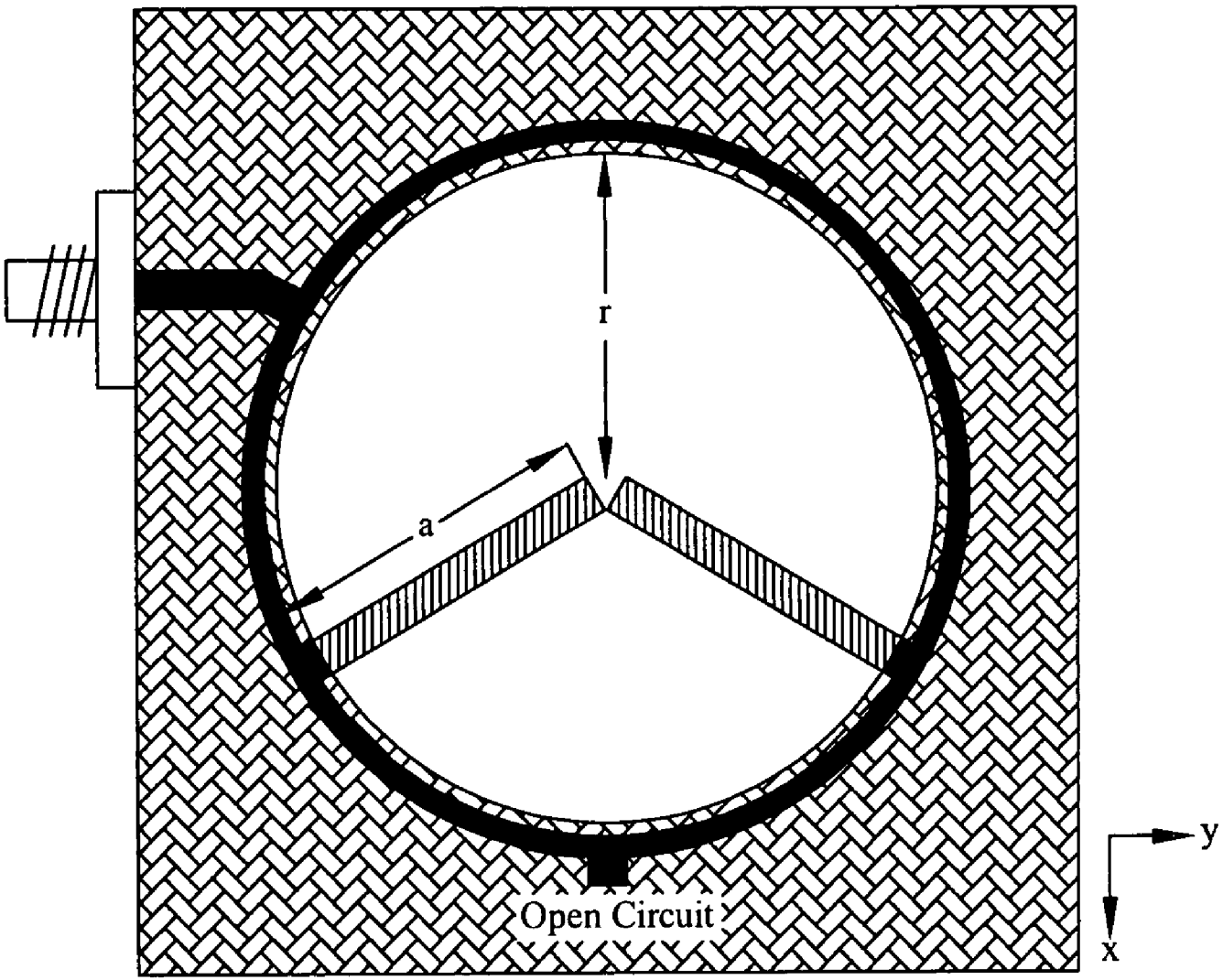
FIG. 4 shows a drawing for a second embodiment of the print dipole antenna according to the present invention.
Figure 5:
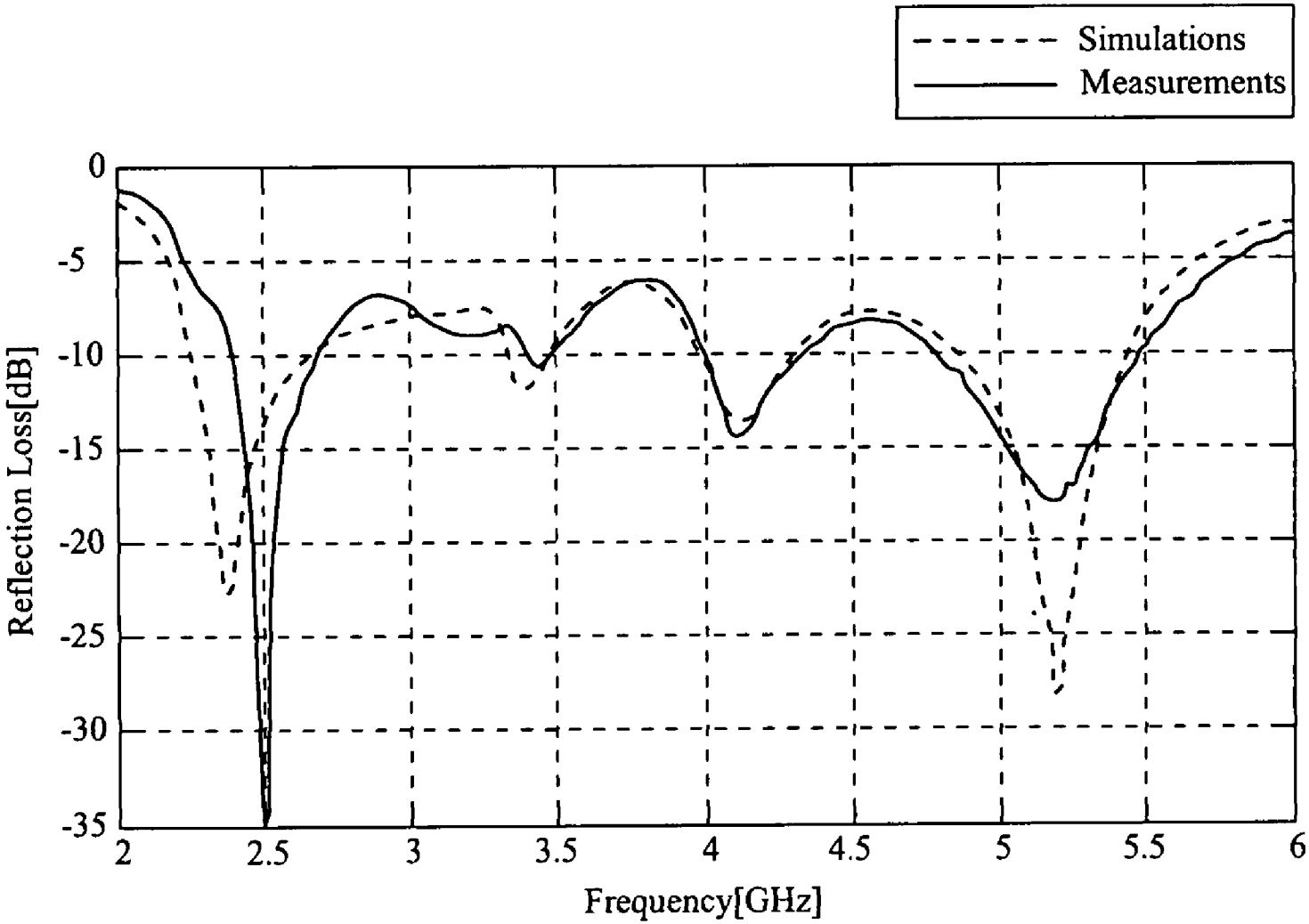
FIG. 5 shows a reflection loss diagram for the simulations and measurements of the second embodiment according to the present invention.
Figure 6A:
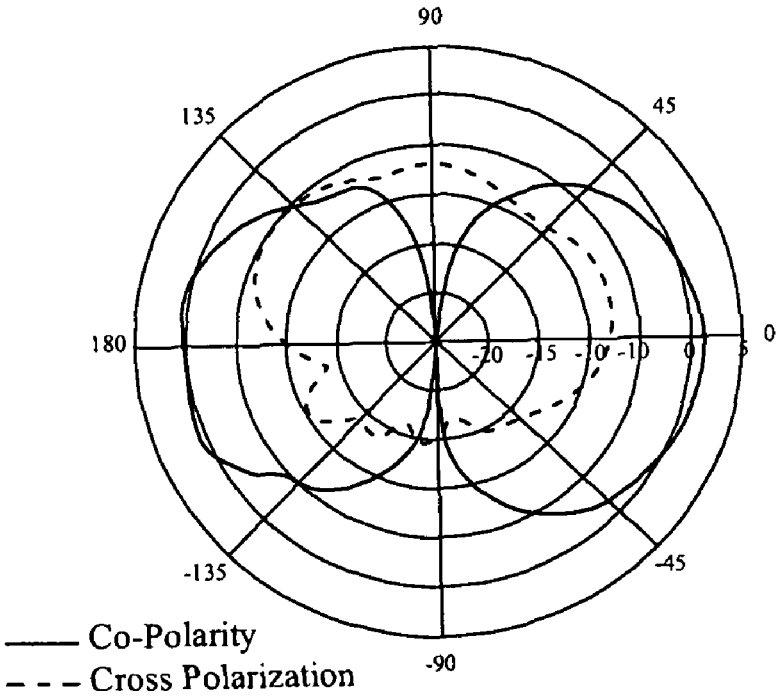
FIGS. 6A and 6B respectively show the diagram for 2-dimensional gain radiation field profile measurements at 2.5 GHz and 5.2 GHz of the second embodiment according to the present invention.
Figure 6A:
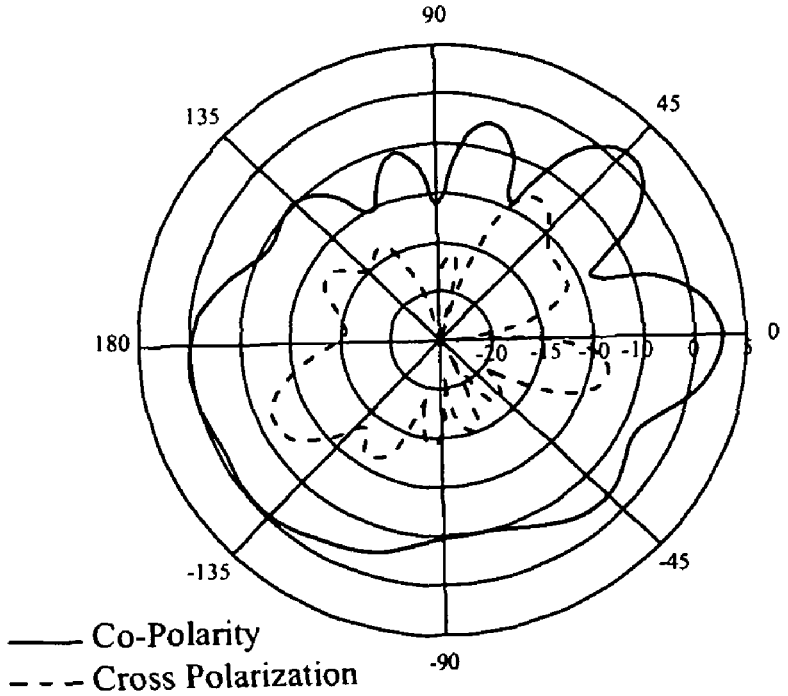
Figure 6B:
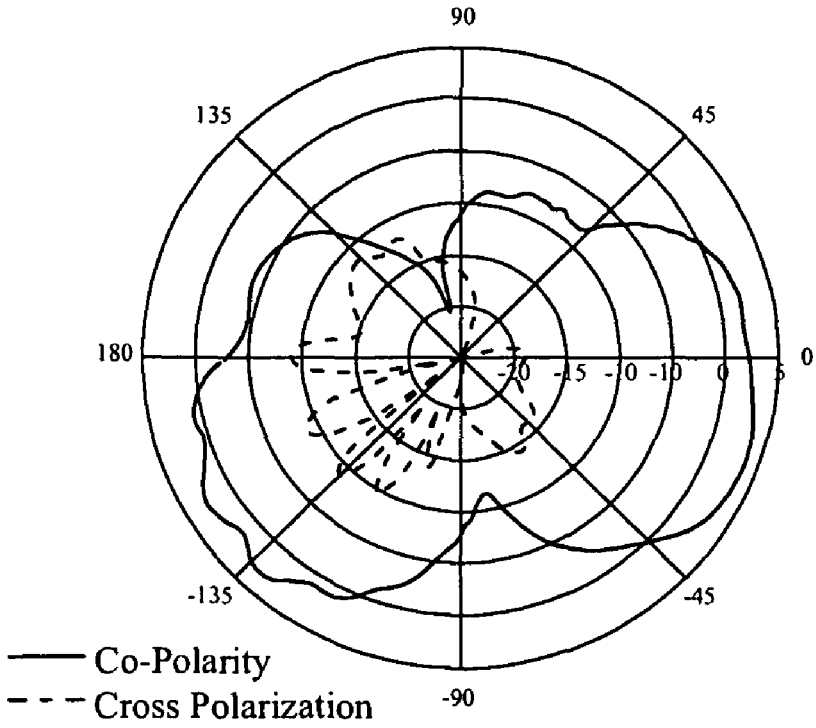
Figure 6B:
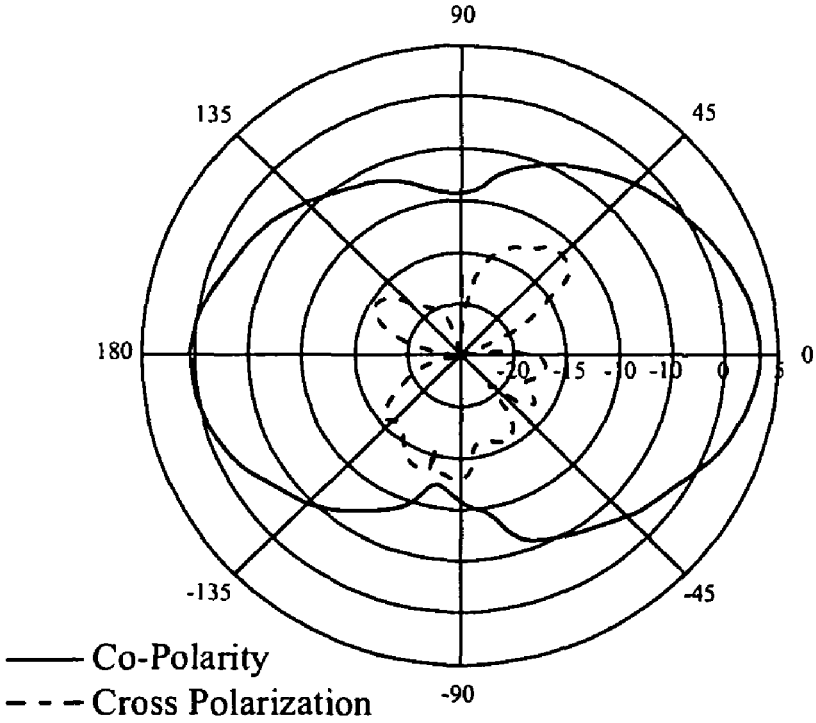

Refer now to FIG. 4, wherein a drawing for a second embodiment of the print dipole antenna according to the present invention is shown. For the print dipole antenna design illustrated in FIG. 2, there exist four resonance frequencies in the 2~6 GHz frequency band, whereas the second embodiment fixes the two times of the central frequency of the ring multiplexer/demultiplexer used as the feed network at the Wireless Local Area Networks (WLANs) 5.2 GHz, and uses the first and the fourth resonance frequencies for frequency band plan so as to construct the dual-frequency operation mode. Herein the lower frequency band is selected to be WLANs 2.4 GHz (2.4-2.484 GHz), and the higher frequency band is WLANs 5.2 GHz (5.15-5.35 GHz). Since the lower frequency resonance frequency is lower than the central frequency 2.6 GHz of the ring multiplexer/demultiplexer, the lengths of the two parasitic metals are accordingly required to be added, which may be achieved by extending the parasitic metals toward the center, or alternatively by increasing the circular area removed from the ground plane in order to modify the lengths of the parasitic metals. As illustrated in FIG. 4, the radius r of the circular area removed from the ground plane is 14 mm, while the length of the two parasitic metals is 14.1 mm. FIG. 5 shows a reflection loss diagram for the simulations and measurements of the second embodiment according to the present invention. From this Figure, it may be seen that the two major operation bands is indeed respectively located in the two frequency bands WLANs 2.4 GHz (2.4-2.484 GHz) and WLANs 5.2 GHz (5.15-5.35 GHz), and simulations are close to the measurements, with just slightly higher frequency drift in the lower frequency resonance frequency measurement ratio, which is possibly caused by insufficient precision in calibration between the implemented grounding layer and the signal layer, but the print dipole antenna may nevertheless encompasses the entire frequency band. The two major operation frequency bands in the Figure are provided by both of the lower frequency and higher frequency resonance frequencies, in which the higher frequency resonance frequency in the measurements is 5.2 GHz and the lower frequency resonance frequency is 2.5 GHz. Furthermore, two resonance frequencies still exist between them, but the reflection loss values thereof have been successfully suppressed under −14 dB. FIGS. 6A and 6B respectively show the diagram for 2-dimensional gain radiation field profile measurements at 2.5 GHz and 5.2 GHz of the second embodiment according to the present invention. Hereunder Table 1 illustrates the simulations and measurements at the each resonance frequency for the print dipole antenna of the first embodiment according to the present invention, in which the measurements for the higher frequency are about 4 dBi.

TABLE 1

| Simulation Resonance Frequency (GHz) | Measurement Resonance Frequency (GHz) | Measurement Resonance Frequency S11 (dB) | Measurement Resonance Frequency Gain (dBi) | Primary Polarity Direction (φ) |
|---|---|---|---|---|
| 2.42 | 2.5 | −34.67 | 2.8 | 0° |
| 5.2 | 5.2 | −17.88 | 3.87 | 90° |

Figure 7:
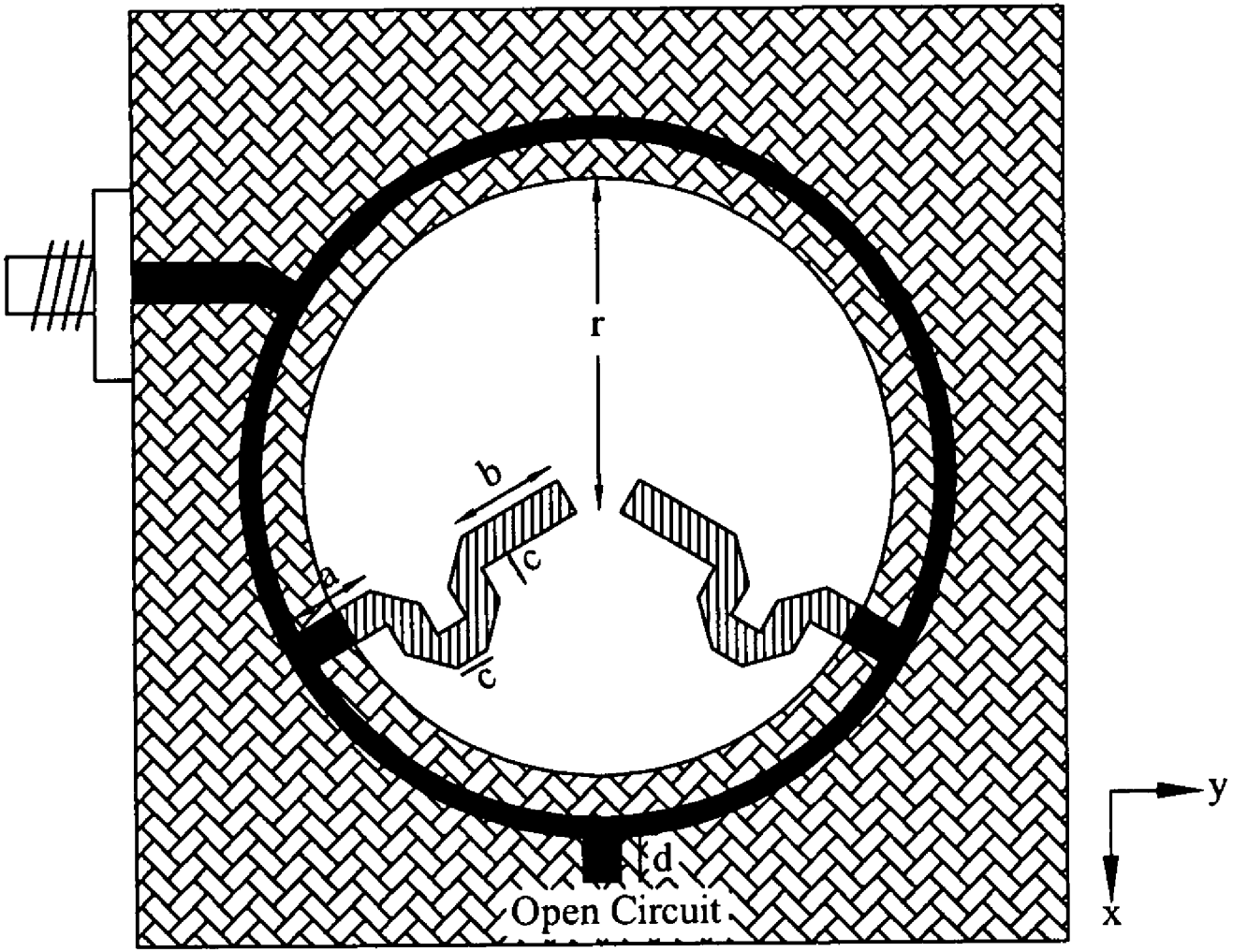
FIG. 7 shows a drawing for a third embodiment of the print dipole antenna according to the present invention.

Refer in continuation to FIG. 7, wherein a drawing for a third embodiment of the print dipole antenna according to the present invention is shown. The third embodiment fixes two times of the central frequency of the ring multiplexer/demultiplexer at WLANs 5.2 GHz, and uses the second and the fourth frequency bands for frequency band plan in order to build the dual-frequency operation mode. Herein the lower frequency band is selected to be Worldwide Interoperability for Microwave Access (WiMAX) 3.5 GHz (3.4-3.7 GHz), and the higher frequency band is still WLANs 5.2 GHz. The goal of the third embodiment is to allow the second resonance frequency of the print dipole antenna to be located nearby 3.5 GHz, and to refrain the first resonance frequency from creating an even lower operation band; therefore, in design, it may first shorten the lengths of the two parasitic metals, meanwhile reduce the circular area removed from the ground plane, and construct the required impedance matching by means of the vertical windings in the parasitic metals and extending the position of the open circuit at the summation end port (as shown in FIG. 7), thereby enabling connection in series of the first three resonance frequencies to create a wider frequency band, and the central frequency of such a frequency band being located at the second resonance frequency of the print dipole antenna. The following Table 2 illustrates each parameter for the size of the print dipole antenna according to the third embodiment.

TABLE 2

| | | | | | |
|---|---|---|---|---|---|
| a | 3.6 | b | 4.7 | c | 1.5 |
| d | 1.9 | r | 13.2 | Unit: mm | |

Figure 8:
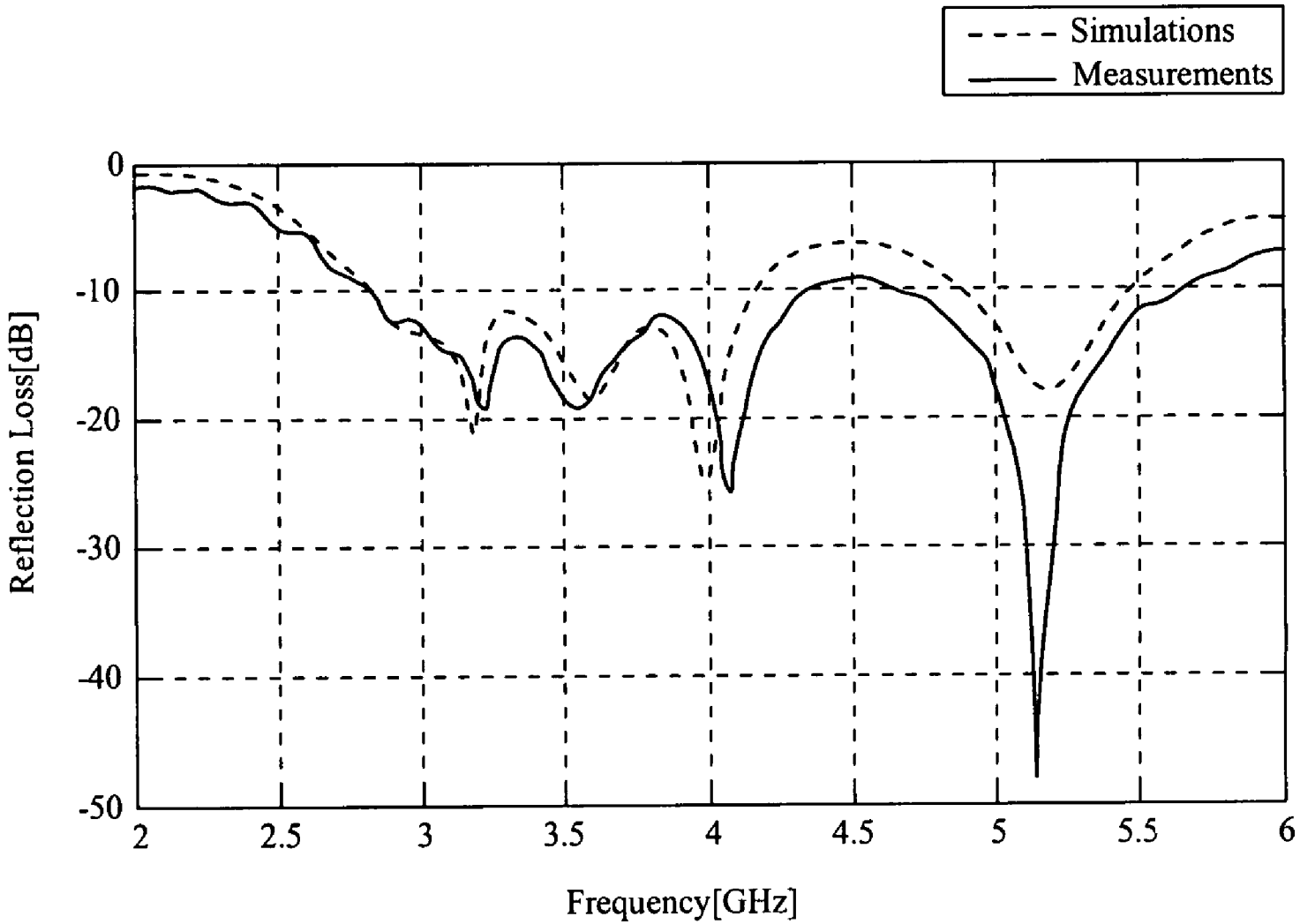
FIG. 8 shows a reflection loss diagram for the simulations and measurements of the third embodiment according to the present invention.
Figure 9A:
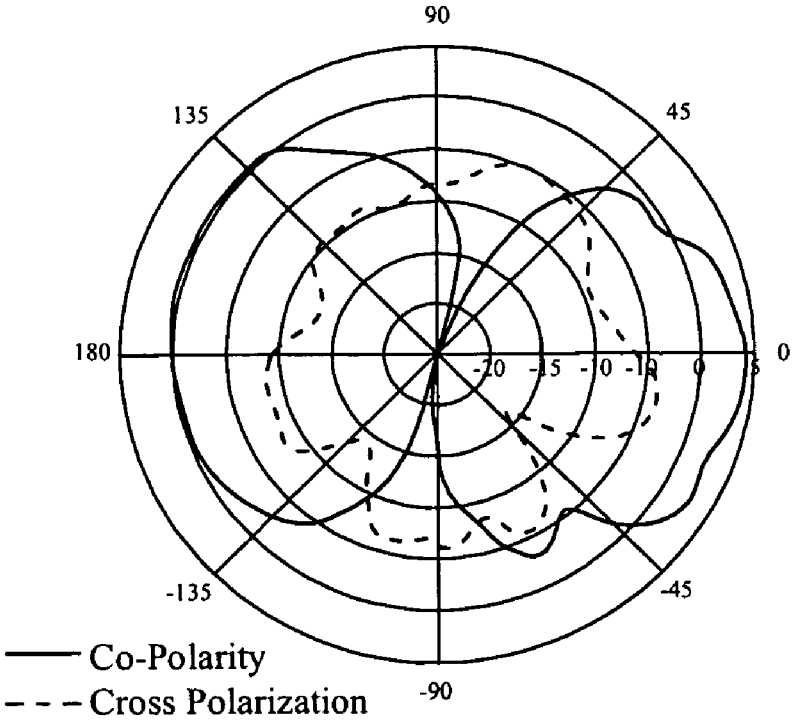
FIGS. 9A and 9B respectively show the diagram for 2-dimensional gain radiation field profile measurements at 3.51 GHz and 5.16 GHz of the third embodiment according to the present invention.
Figure 9A:
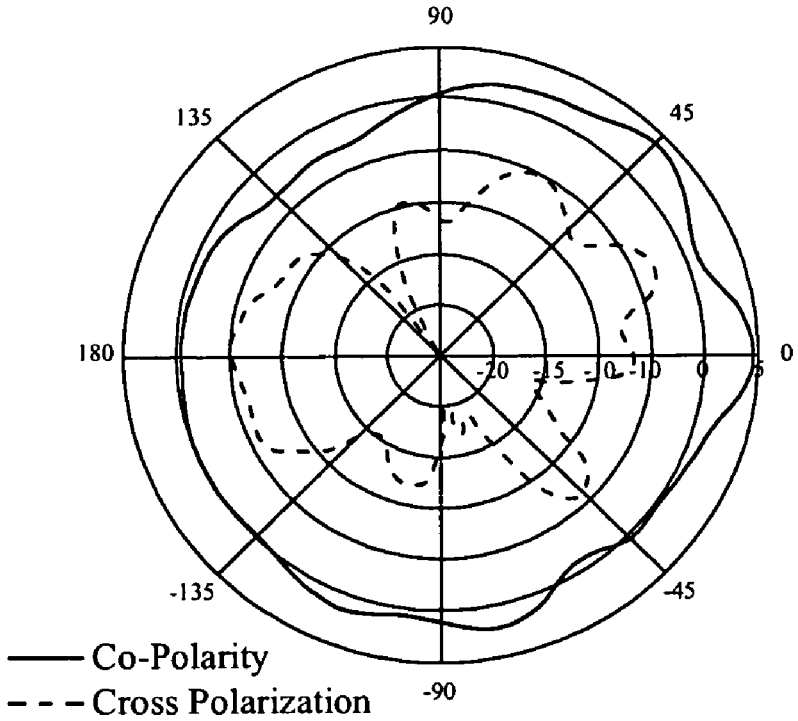
Figure 9B:
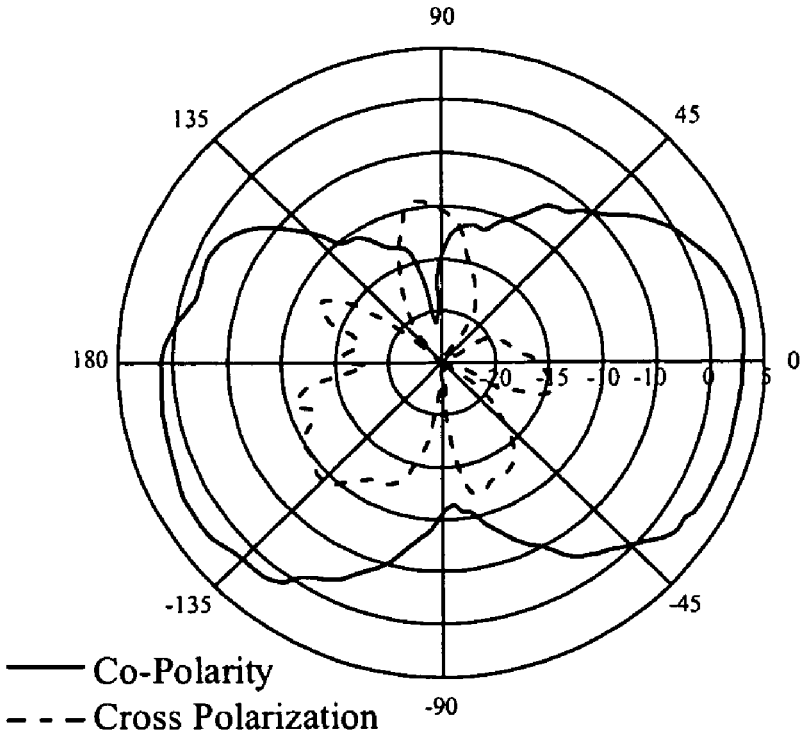
Figure 9B:
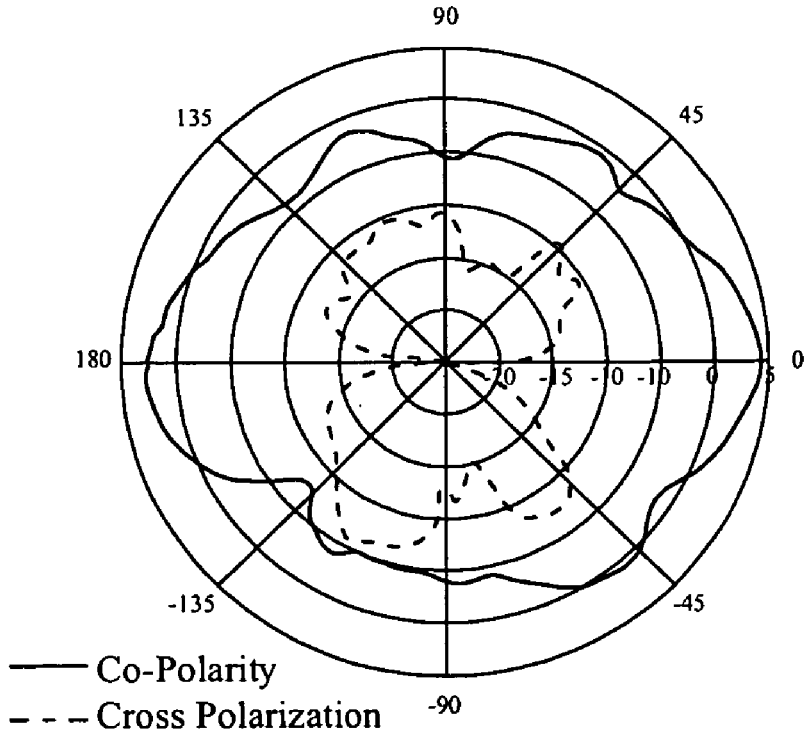

FIG. 8 shows a reflection loss diagram for the simulations and measurements of the third embodiment. From the Figure, it may be seen that the simulations and measurements are quite close, in which two operation frequency bands exist in 2~6 GHz, respectively covering frequency bands including WiMAX 3.5 GHz (3.4-3.7 GHz) and WLANs 5.2 GHz (5.15-5.35 GHz). The lower frequency operation frequency band is formed by connecting in series the first three resonance frequencies of the print dipole antenna, in which the bandwidth thereof can reach up to 1.56 GHz, and the second resonance frequency may be successfully designated at the central frequency of such a frequency band, 3.5 GHz. The higher frequency operation frequency band is provided by the resonance frequency located about two times of central frequency of the ring multiplexer/demultiplexer, and the measurement higher frequency resonance frequency is 5.16 GHz. FIGS. 9A and 9B respectively show the diagram for 2-dimensional gain radiation field profile measurements at 3.51 GHz and 5.16 GHz of the third embodiment according to the present invention, and Table 3 lists simulations and measurements for each resonance frequency of the print dipole antenna according to the third embodiment, in which, when the operation frequency is located at 3.5 GHz, the primary polarity direction revealed by simulating co-polarity and cross polarity gains at various angles is along a plane facing in the direction of −16 degrees against the x axis, and the reason for such a result is essentially that, when the print dipole antenna operates at 3.5 GHz, radiation effect is provided by a pair of unbalanced signals having the same phase, different amplitude on the two parasitic metals, whereas the current on the right parasitic metal dominates the primary radiation effect of the antenna, thus the right slant current becomes dominant.

TABLE 3

| Simulation Resonance Frequency (GHz) | Measurement Resonance Frequency (GHz) | Measurement Resonance Frequency S11 (dB) | Measurement Resonance Frequency Gain (dBi) | Primary Polarity Direction (φ) |
|---|---|---|---|---|
| 3.5 | 3.51 | −18.83 | 4.56 | −16° |
| 5.2 | 5.16 | −48.75 | 4.38 | 90° |

Figure 10:
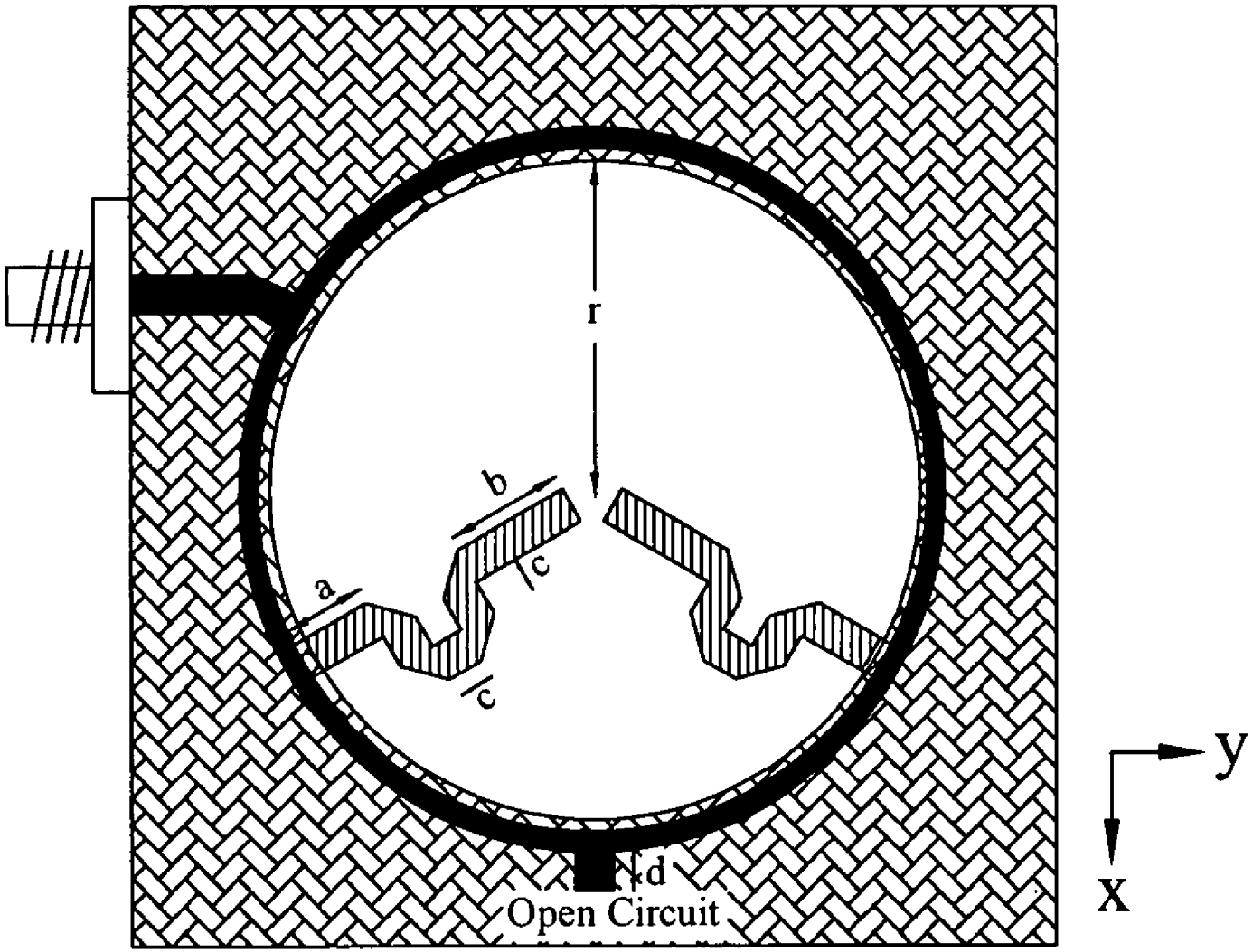
FIG. 10 shows a drawing for a fourth embodiment of the print dipole antenna according to the present invention.

Refer next to FIG. 10, wherein a drawing for a fourth embodiment of the print dipole antenna according to the present invention is shown. The frequency bands selected in the fourth embodiment are respectively WiMAX 2.6 GHz, WiMAX 3.5 GHz and WLANs 5.2 GHz, and since three resonance frequencies, i.e. the first, the second and the fourth resonance frequencies, are used for frequency band plan in order to create a tri-frequency operation mode, the frequency band generated by the third resonance frequency must be well suppressed. Because the lower frequency resonance frequency is just located at the central frequency of the ring multiplexer/demultiplexer, it is not necessary to particularly extend or shorten the lengths of the two parasitic metals, but rather, the impedance matching of the antenna may be adjusted by means of etching off a circular area having appropriate size from the center of the ground plane, changing positions and lengths of vertical windings in the parasitic metals, and also modifying position of the open circuit at the summation end port (as shown in FIG. 10) in order to satisfy the demands in design requirements. The following Table 4 illustrates each parameter for the size of the print dipole antenna according to the fourth embodiment.

TABLE 4

| | | | | | |
|---|---|---|---|---|---|
| a | 3.6 | b | 5.2 | c | 1.5 |
| d | 1.6 | r | 13.4 | Unit: mm | |

Figure 11:
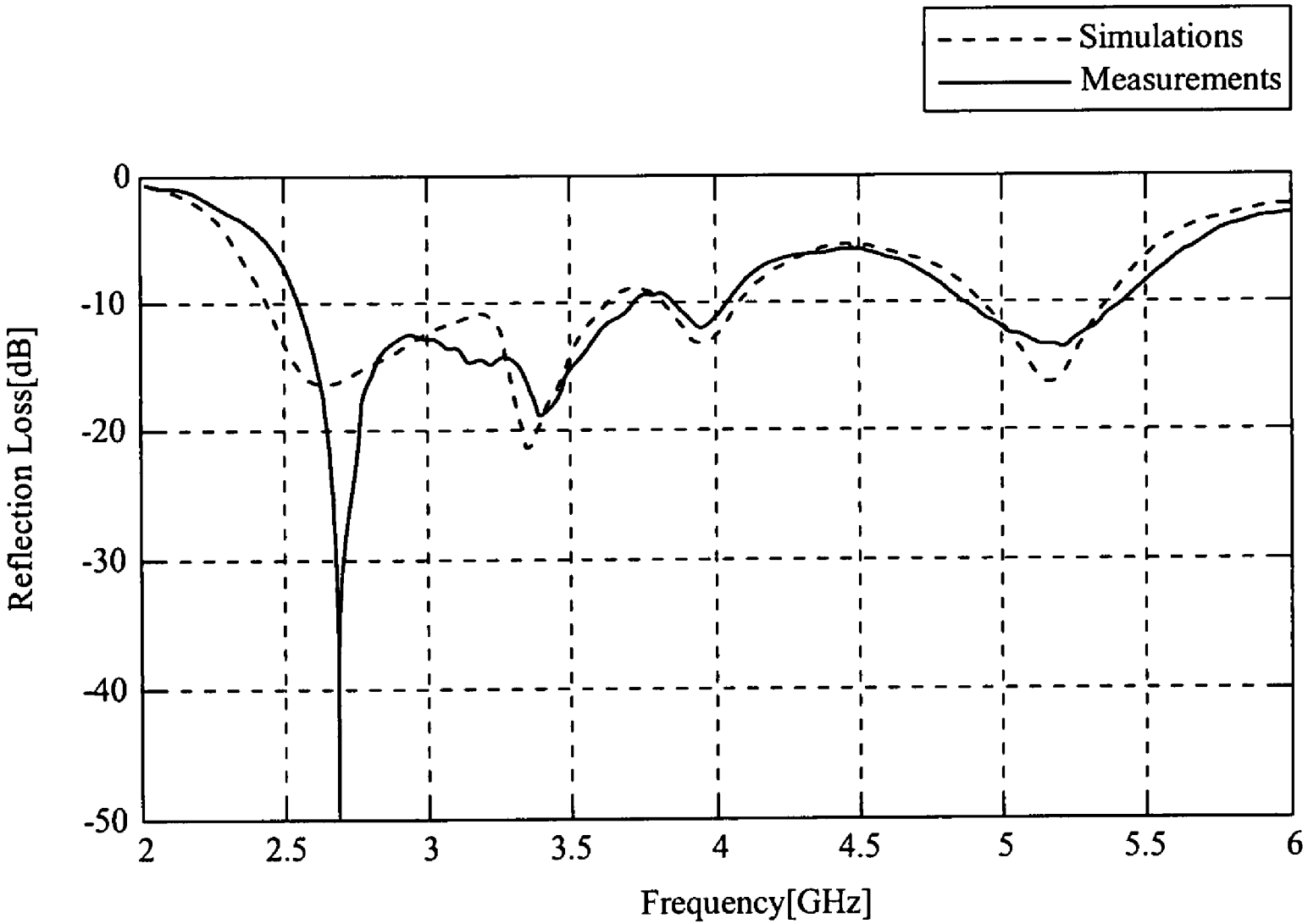
FIG. 11 shows a reflection loss diagram for the simulations and measurements of the fourth embodiment according to the present invention.
Figure 12A:
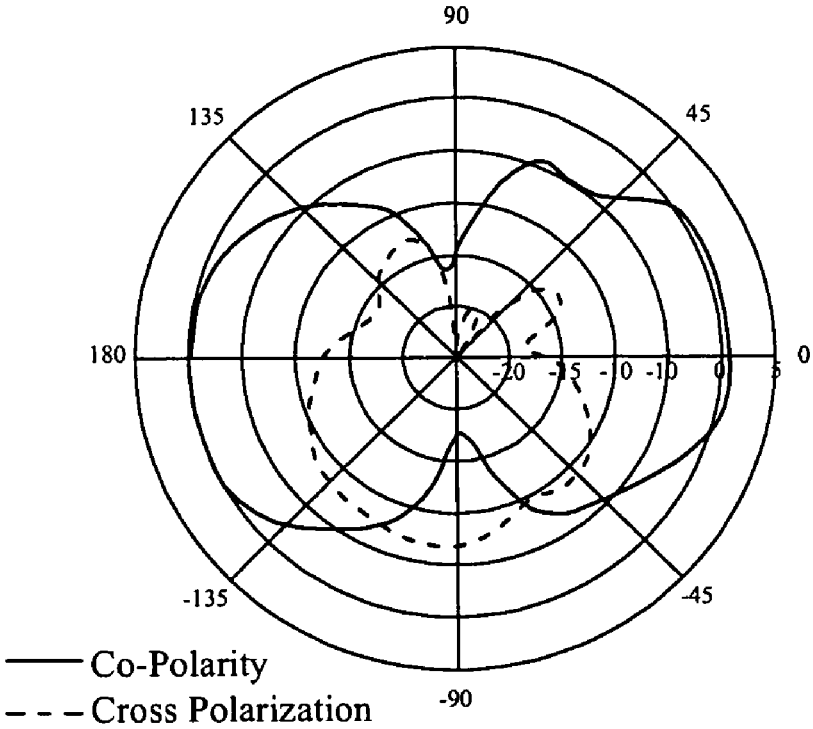
FIGS. 12A-12C respectively show the diagram for 2-dimensional gain radiation field profile measurements at 2.68 GHz, 3.4 GHz and 5.2 GHz of the fourth embodiment according to the present invention.
Figure 12A:
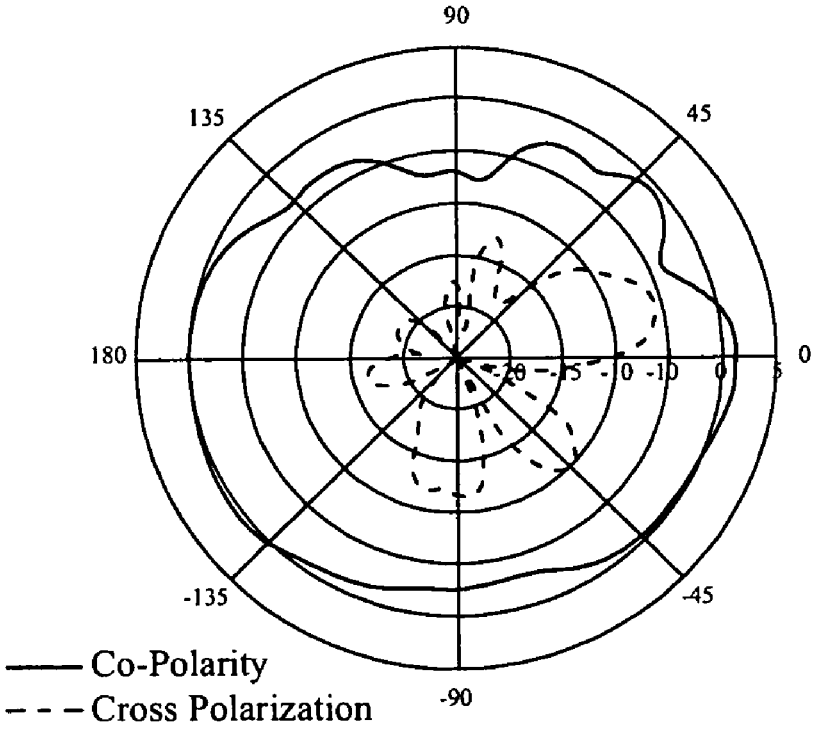
Figure 12B:
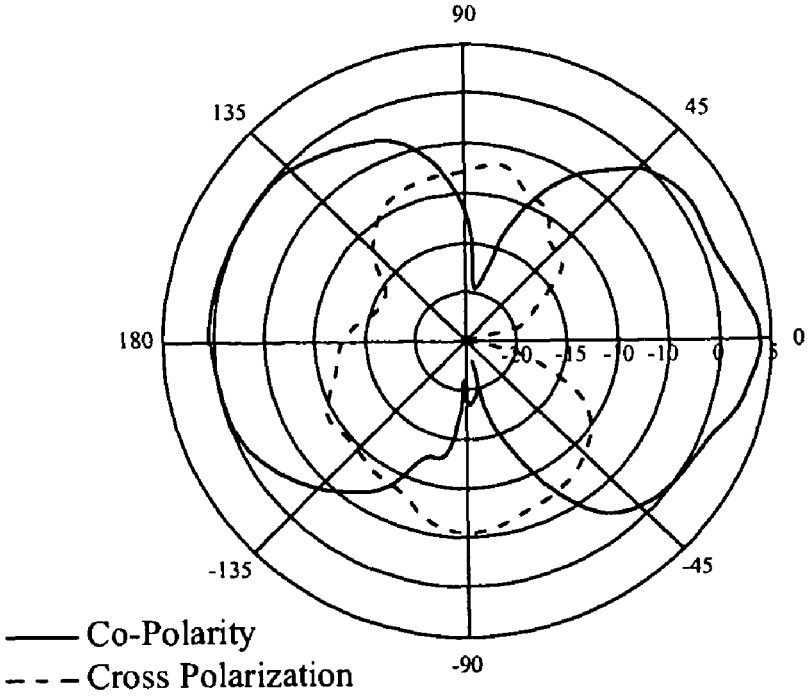
Figure 12B:
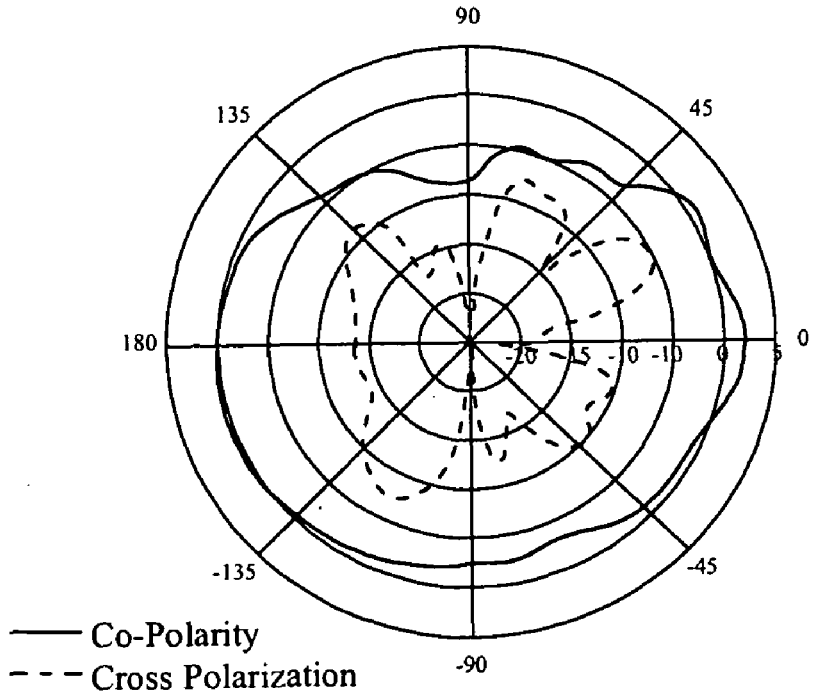
Figure 12C:
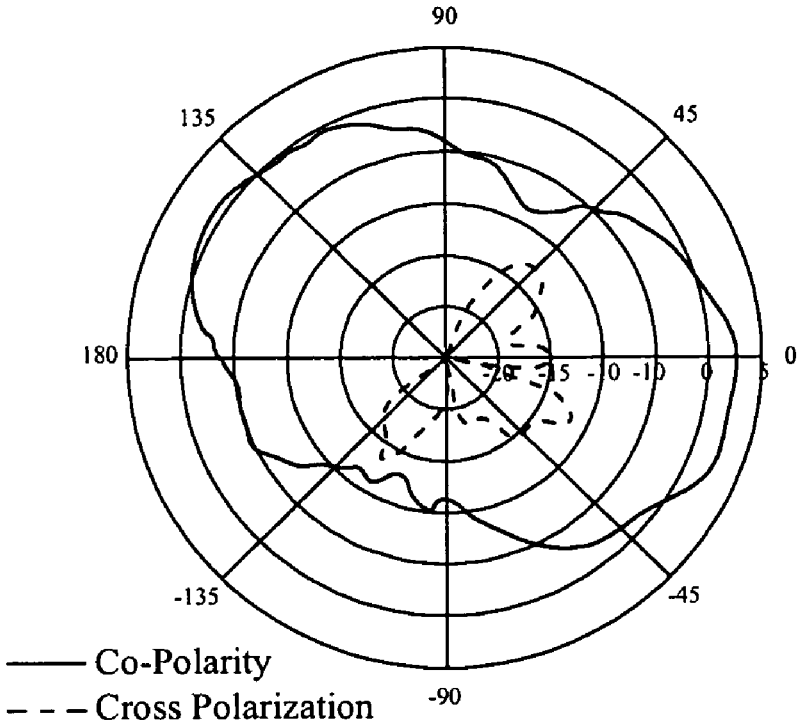
Figure 12C:
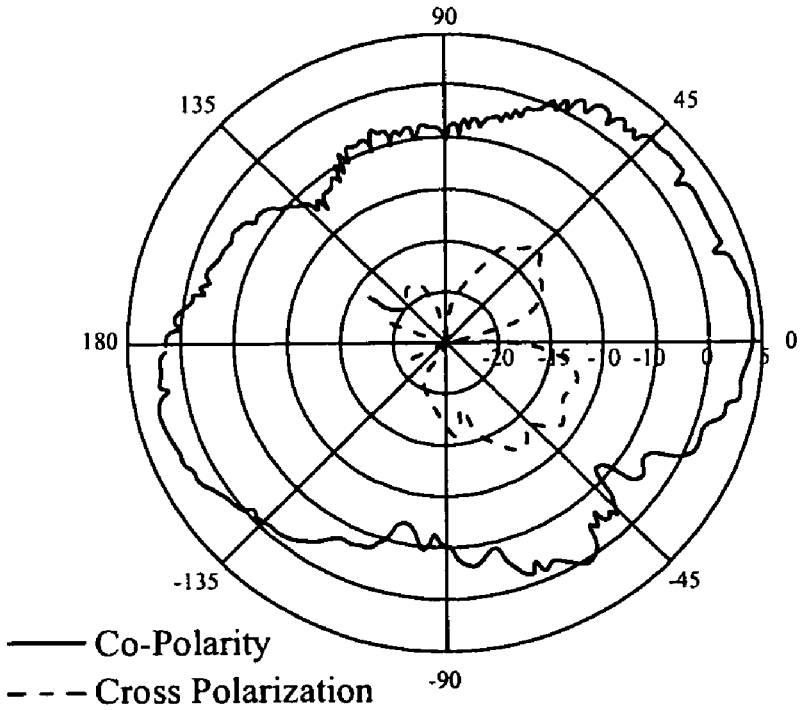

FIG. 11 shows a reflection loss diagram for the simulations and measurements of the fourth embodiment. It may be seen from the Figure that the simulations and measurements are quite close, in which there are three major resonance frequencies in 2~6 GHz, respectively the first, the second and the fourth resonance frequency of the antenna, and the generated operation frequency bands encompass three frequency bands, namely WiMAX 2.6 GHz (2.5-2.7 GHz), WiMAX 3.5 GHz (3.4-3.7 GHz) and WLANs 5.2 GHz (5.15-5.35 GHz). At the same time, the frequency band generated by the third resonance frequency nearby 4 GHz has been successfully suppressed, whose reflection loss value is controlled below −12 dB. However, this may conjunctively cause the higher frequency resonance frequency reflection loss to be about merely −14 dB. From the reflection loss simulations and measurements, it may be inferred that the first resonance frequency is designated at the central frequency of the ring multiplexer/demultiplexer, thereby allowing the first two resonance frequencies to connect in series to create a wider operation frequency band. FIGS. 12A-12C respectively show the diagram for 2-dimensional gain radiation field profile measurements at 2.68 GHz, 3.4 GHz and 5.2 GHz of the fourth embodiment, and Table 5 shows simulations and measurements of each resonance frequency of the print dipole antenna according to the fourth embodiment, in which, at 3.5 GHz, the primary polarization direction of the antenna is along a plane facing in the direction of −28 degrees against the x axis. The lower frequency gain is about 2~3 dBi, and central/higher frequency gain is about 3~4 dBi.

TABLE 5

| Simulation Resonance Frequency (GHz) | Measurement Resonance Frequency (GHz) | Measurement Resonance Frequency S11 (dB) | Measurement Resonance Frequency Gain (dBi) | Primary Polarity Direction (ϕ) |
|---|---|---|---|---|
| 2.64 | 2.68 | −49.84 | 1.5 | 0° |
| 3.34 | 3.4 | −19.06 | 3.8 | −28° |
| 5.16 | 5.2 | −13.63 | 4.11 | 90° |

Figure 13:
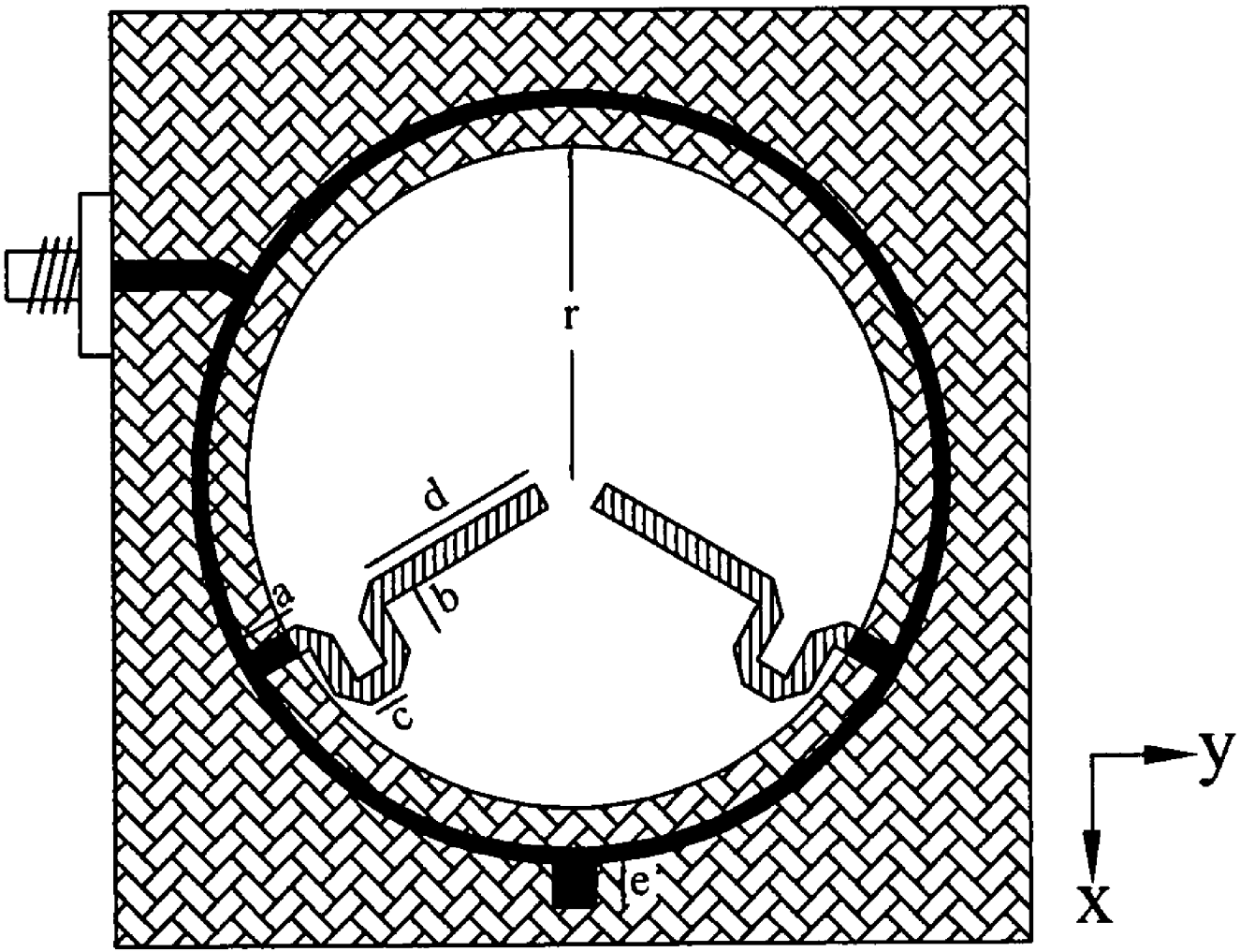
FIG. 13 shows a drawing for a fifth embodiment of the print dipole antenna according to the present invention.

Refer subsequently to FIG. 13, wherein a drawing for a fifth embodiment of the print dipole antenna according to the present invention is shown. The fifth embodiment is intended to more effectively exploit all resonance frequencies within two times of the central frequency of the ring multiplexer/demultiplexer, and since many common communication system frequency bands exist between frequency bands 1.7 GHz to 3 GHz, if the two times of central frequency is designed to be located at WiMAX 3.5 GHz, then when operating around lower frequency central frequency, it is possible to provide such communication systems with frequency bands required for normal operations; therefore, the two times of the central frequency is chosen to be 3.5 GHz, and at the same, the integral operation frequency bands are also herein determined. The structure of the print dipole antenna in the fifth embodiment is shown as FIG. 13, whose detailed specifications comprise: the central frequency of the ring multiplexer/demultiplexer is 1.75 GHz; the dielectric substrate is an FR-4 substrate of thickness 0.8 mm and permittivity 4.4; width w of the ground plane metal layer is 55 mm; the width of the line having characteristic impedance 50 Ohms and 70.71 Ohms is respectively 1.53 mm and 0.803 mm; other parameters are listed in Table 6.

TABLE 6

| | | | | | |
|---|---|---|---|---|---|
| w | 55 | b | 3.1 | e | 1.1 |
| r | 19.4 | c | 2.1 | Unit: mm | |
| a | 4 | d | 11.5 | | |

Figure 14:
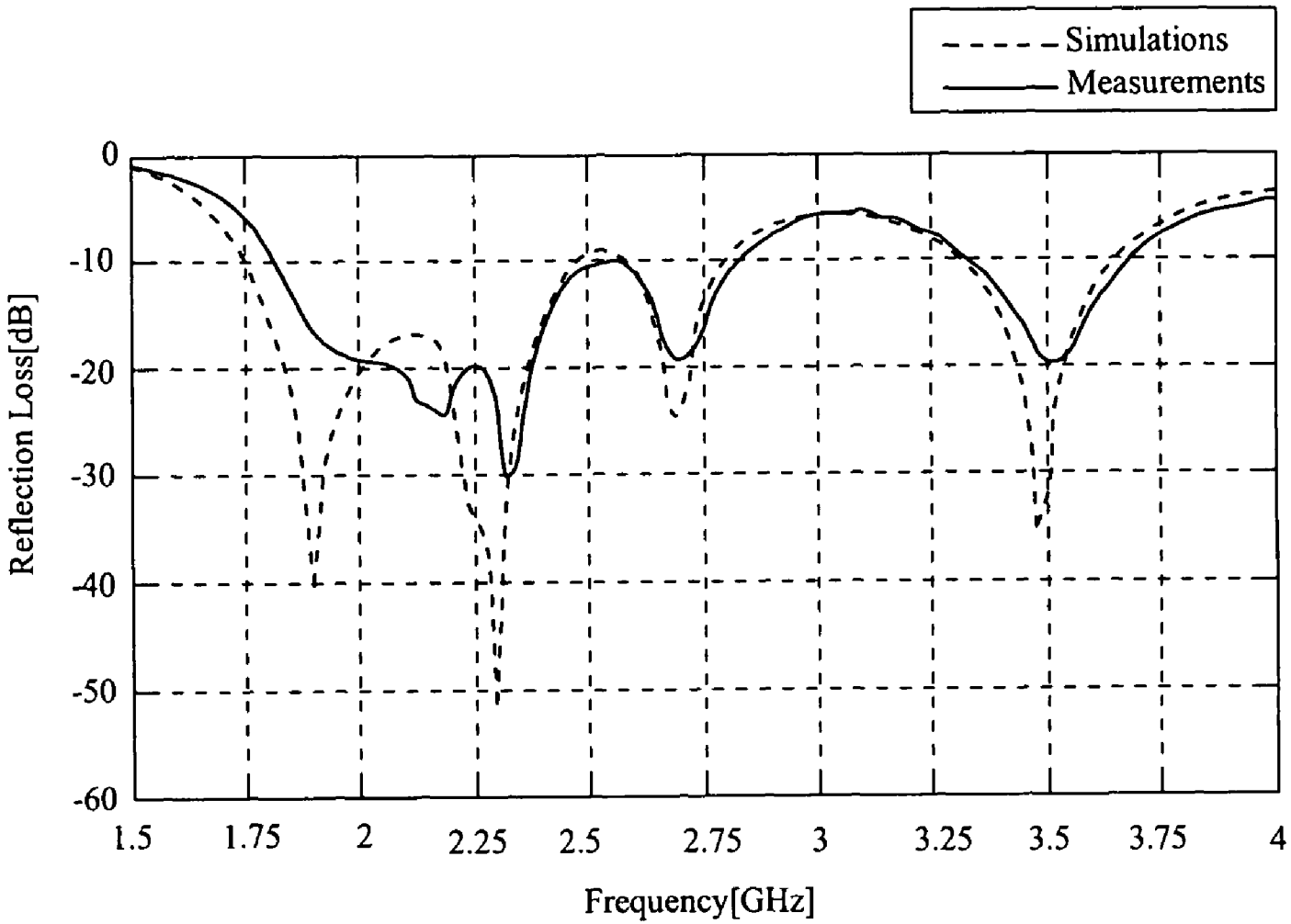
FIG. 14 shows a reflection loss diagram for the simulations and measurements of the fifth embodiment according to the present invention.
Figure 15A:
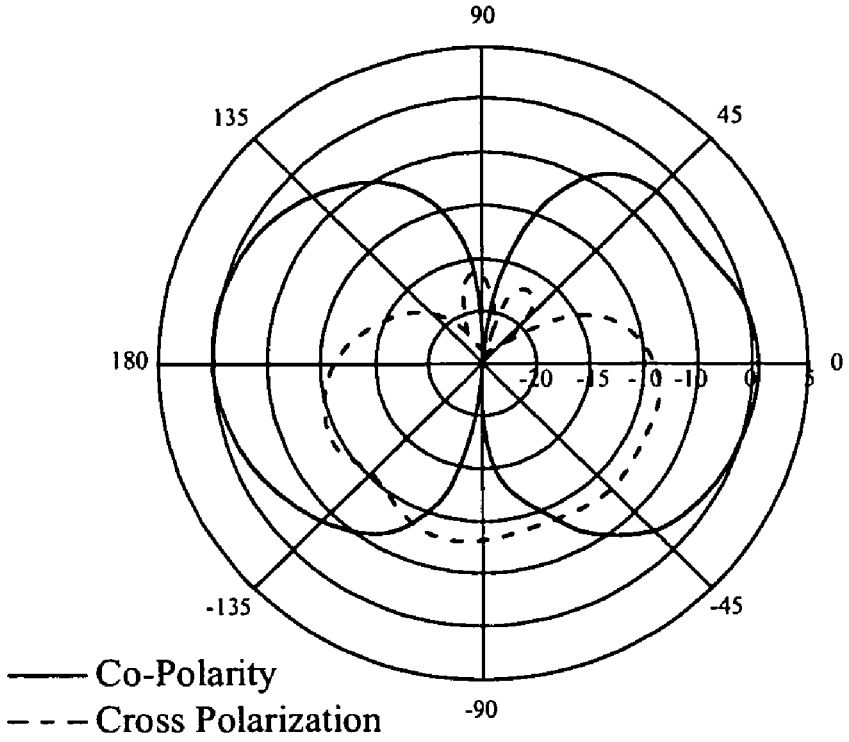
FIGS. 15A-15E respectively show the diagram for 2-dimensional gain radiation field profile measurements at 1.8 GHz, 2 GHz, 2.45 GHz, 2.6 GHz and 3.5 GHz of the fifth embodiment according to the present invention.
Figure 15A:
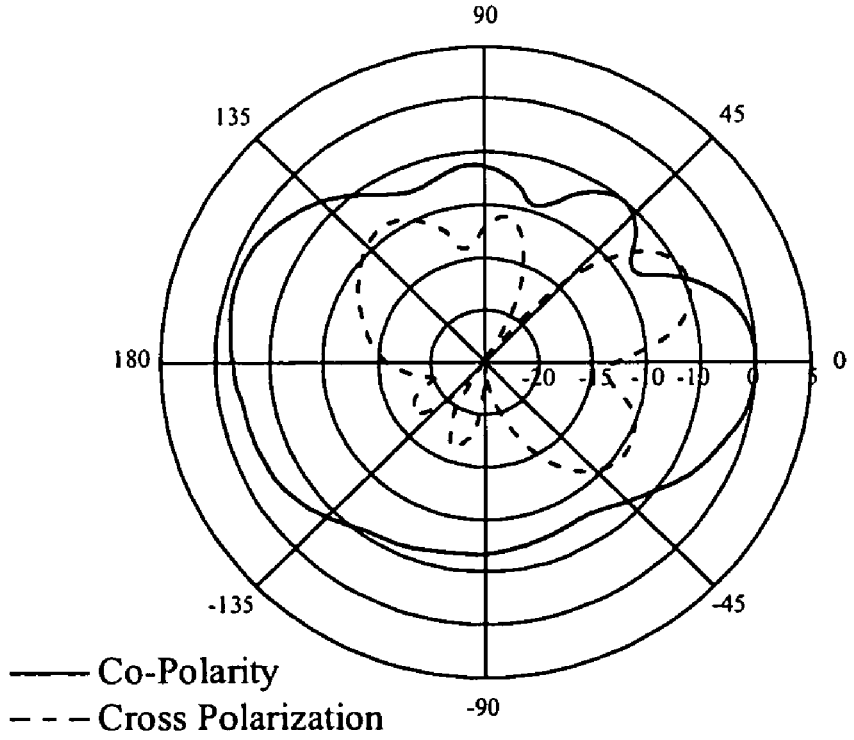
Figure 15B:
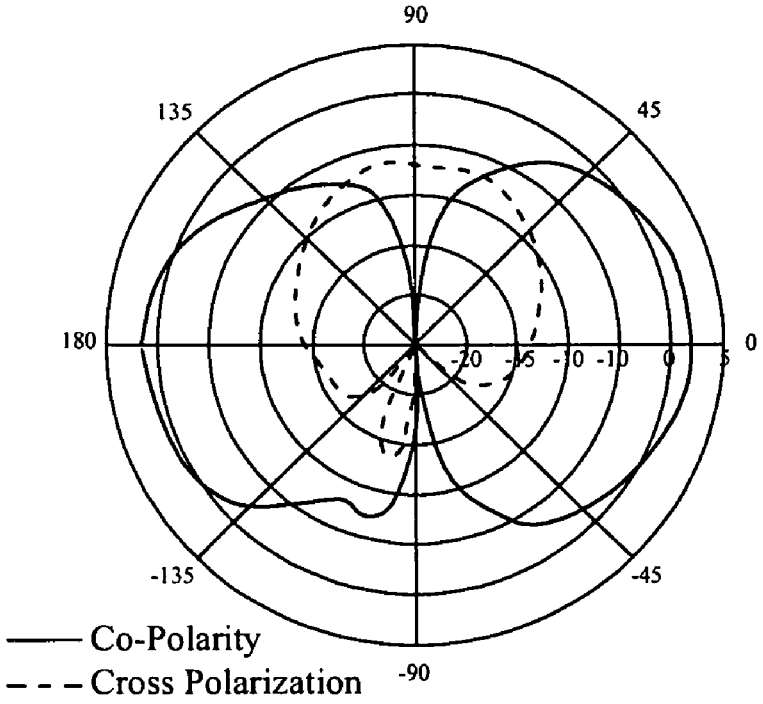
Figure 15B:
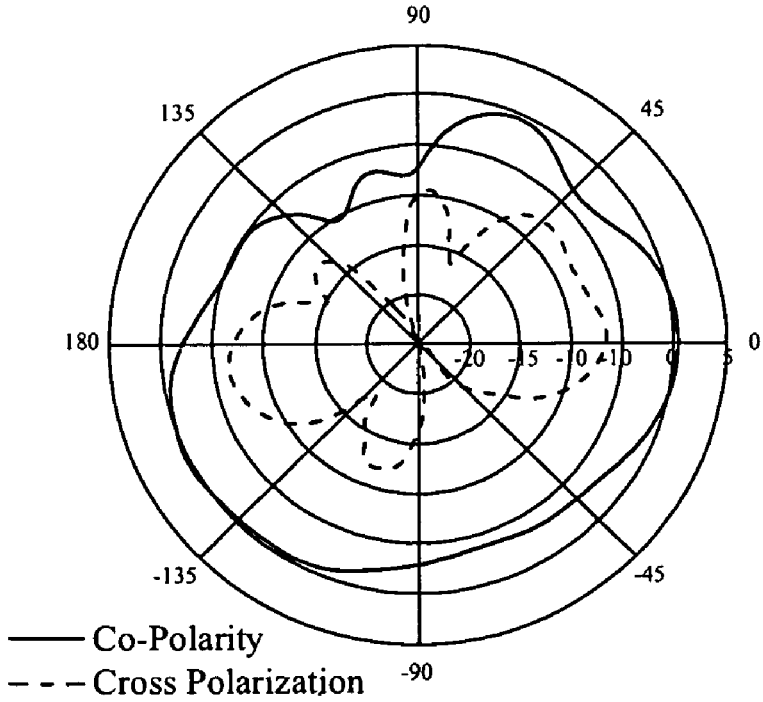
Figure 15C:
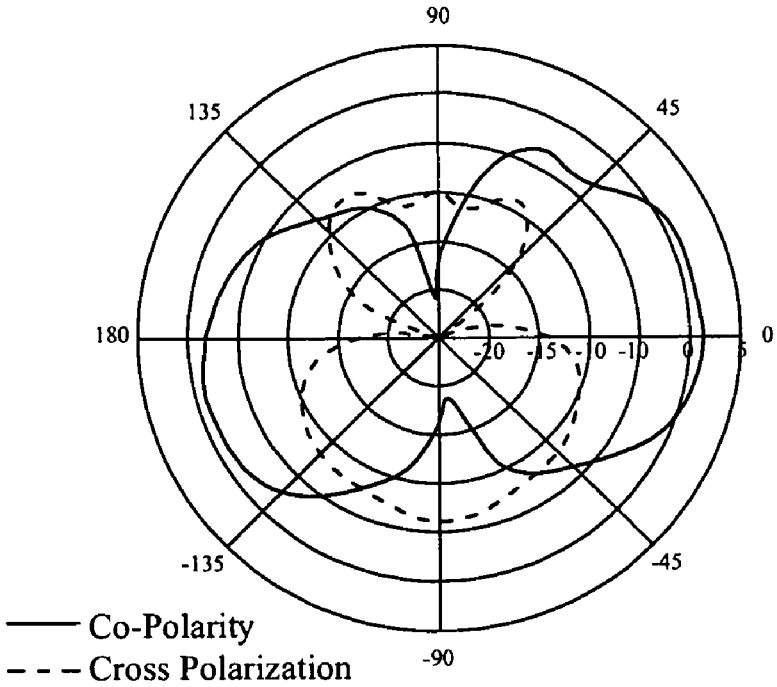
Figure 15C:
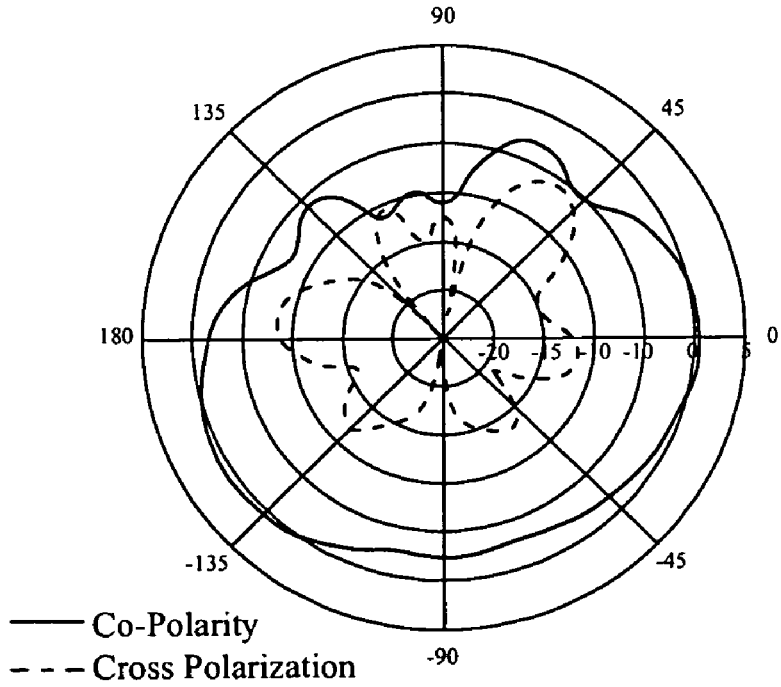
Figure 15D:
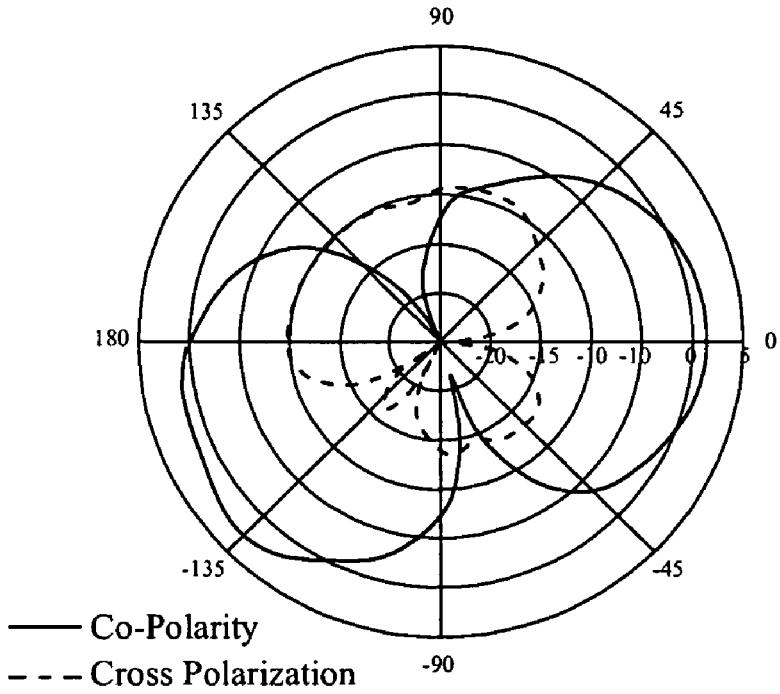
Figure 15D:
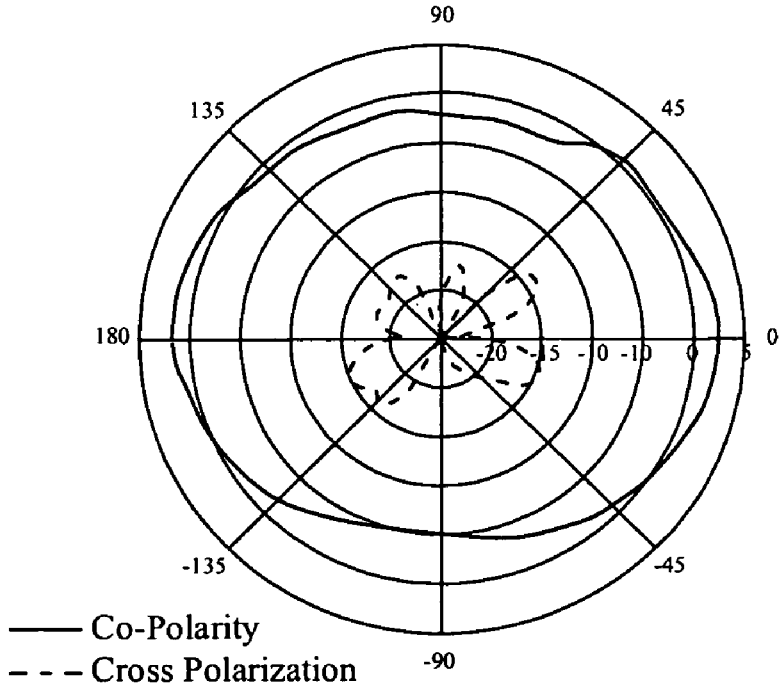
Figure 15E:
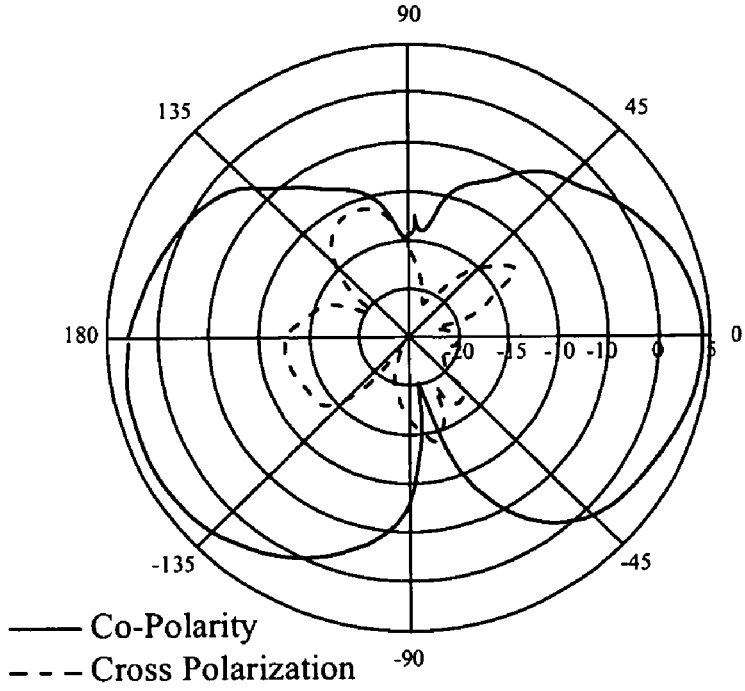
Figure 15E:
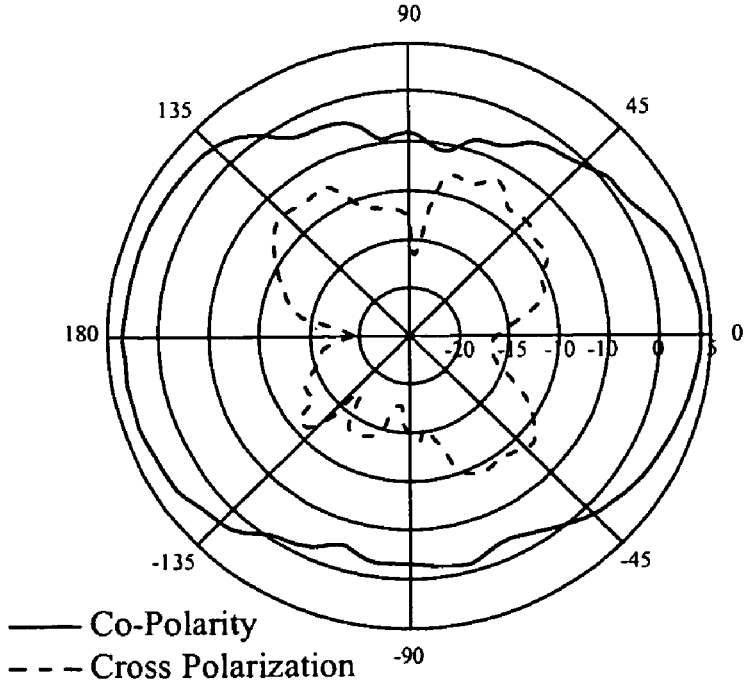

FIG. 14 shows a reflection loss diagram for the simulations and measurements of the fifth embodiment. From the Figure, it may be seen that there are three operation frequency bands in 1.5~4 GHz, including four resonance frequencies therein. Simulations and measurements in the central and higher frequency bands are quite close, but significant deviation occurs at lower frequency band curve; however, since reflection loss in such a frequency band is below −10 dB, along with wideband feature, so this difference does not cause conspicuous influence on practical applications. Besides, the three operation frequency bands of the print dipole antenna in the fifth embodiment cover DCS 1800 frequency band (1710-1880 MHz), American PCS 1900 frequency band (1850-1990 MHz), UMTS of European 3G frequency band (1920-2170 MHz), WLANs 2.4 GHz (2400-2484 MHz), ISM frequency band in Microwave Tag Identification System (2400 MHz-2483.5 MHz), and WiMAX 2.6 GHz (2.5-2.7 GHz), WiMAX 3.5 GHz (3.4-3.7 GHz) etc. From this, it proves that the present invention may effectively use the operation frequency bands generated by the four resonance frequencies of the antenna, and have them successfully planned into different communication frequency bands. Due to wide frequency band coverage of the antenna, in order to facilitate better understanding about the radiation features of the antenna during operation at each communication frequency band, measurement frequencies are selected to be at the central frequencies of several communication frequency bands. FIGS. 15A, 15B, 15C, 15D and 15E respectively show the diagram for 2-dimensional gain radiation field profile measurements at 1.8 GHz, 2 GHz, 2.45 GHz, 2.6 GHz and 3.5 GHz of the fifth embodiment, and Table 7 indicates the measurements at each resonance frequency of the print dipole antenna of the fifth embodiment, wherein the gain at each frequency band is approximately from 1 to 5 dBi.

TABLE 7

| Measurement Frequency (GHz) | Measurement Reflection Loss (dB) | Measurement Gain (dBi) |
|---|---|---|
| 1.8 | −10.58 | 0.65 |
| 2 | −18.88 | 2.35 |
| 2.45 | −13.03 | 1.17 |
| 2.6 | −11.16 | 2.58 |
| 3.5 | −19.56 | 4.52 |

The aforementioned descriptions are simply exemplary, rather than being limiting. All effectively equivalent modifications or changes made to the illustrated embodiments without departing from the spirit and scope of the present invention are to be considered as being embraced within the claims set forth hereinafter.

What is claimed is:

1. A print dipole antenna having a plurality of resonance frequencies, comprising:

a substrate;

a ring microstrip line, disposed on one side of the substrate;

a plurality of parasitic metals, symmetrically disposed in the interior of the ring microstrip line; and a ground plane, disposed on the other side of the substrate, and having a hollow portion corresponding to the central area of the ring microstrip line.

2. The print dipole antenna according to claim 1, wherein a normal mode signal is fed from the end points the plurality of parasitic metals.

3. The print dipole antenna according to claim 1, wherein the shape of the plurality of parasitic metals is linear or bended in windings.

4. The print dipole antenna according to claim 3, wherein the positions of the plurality of resonance frequencies are controlled by the size of the hollow portion, the length of extensions or windings in the plurality of parasitic metals or the positions of the lengths of windings in the plurality of parasitic metals.

5. The print dipole antenna according to claim 1, wherein the shape of the ring microstrip line is circular, oval, polygonal or any symmetrical shape.

6. The print dipole antenna according to claim 1, wherein the ring microstrip line has a plurality of end ports, including input end ports and output end ports.

7. The print dipole antenna according to claim 6, wherein the output end ports are oriented toward the interior of the ring microstrip line for connecting to the plurality of parasitic metals.

8. The print dipole antenna according to claim 6, wherein the ring microstrip line further comprises an open circuit end.

9. The print dipole antenna according to claim 6, wherein the signals at the output end ports have different phase shift and different amplitude ratio based on the operation frequency.

10. A manufacturing method of the print dipole antenna having a plurality of resonance frequencies, comprising the following steps:

providing a substrate;

disposing a ring microstrip line on one side of the substrate;

symmetrically disposing a plurality of parasitic metals in the interior of the ring microstrip line; and disposing a ground plane having a hollow portion on the other side of the substrate, wherein the hollow portion corresponds to the central area of the ring microstrip line.

11. The manufacturing method of the print dipole antenna according to claim 10, wherein a normal mode signal is fed from the end points of the plurality of parasitic metals.

12. The manufacturing method of the print dipole antenna according to claim 10, wherein the shape of the plurality of parasitic metals is linear or bended in windings.

13. The manufacturing method of the print dipole antenna according to claim 12, wherein the positions of the plurality of resonance frequencies are controlled by the size of the hollow portion, the length of extensions or windings in the plurality of parasitic metals or the positions of the lengths of windings in the plurality of parasitic metals.

14. The manufacturing method of the print dipole antenna according to claim 10, wherein the shape of the ring microstrip line is circular, oval, polygonal or any symmetrical shape.

15. The manufacturing method of the print dipole antenna according to claim 10, wherein the ring microstrip line has a plurality of end ports, including input end ports and output end ports.

16. The manufacturing method of the print dipole antenna according to claim 15, wherein the output end ports are oriented toward the interior of the ring microstrip line for connecting to the plurality of parasitic metals.

17. The manufacturing method of the print dipole antenna according to claim 15, wherein the ring microstrip line further comprises an open circuit end.

18. The manufacturing method of the print dipole antenna according to claim 15, wherein the signals at the output end ports have different phase shift and different amplitude ratio based on the operation frequency.

* * * * *